US010950980B2

(12) United States Patent
Sunaga

(10) Patent No.: US 10,950,980 B2
(45) Date of Patent: Mar. 16, 2021

(54) CONNECTOR AND CONNECTOR DEVICE

(71) Applicant: HIROSE ELECTRIC CO., LTD., Tokyo (JP)

(72) Inventor: Shiro Sunaga, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/726,861

(22) Filed: Dec. 25, 2019

(65) Prior Publication Data

US 2020/0220307 A1 Jul. 9, 2020

(30) Foreign Application Priority Data

Jan. 7, 2019 (JP) ..... JP2019-000763

(51) Int. Cl.
*H01R 13/6583* (2011.01)
*H01R 24/62* (2011.01)
*H01R 13/6591* (2011.01)
*H01R 107/00* (2006.01)

(52) U.S. Cl.
CPC ..... *H01R 13/6583* (2013.01); *H01R 13/6591* (2013.01); *H01R 24/62* (2013.01); *H01R 2107/00* (2013.01)

(58) Field of Classification Search
CPC ..... H01R 13/6594; H01R 13/6595; H01R 13/6583; H01R 13/6591; H01R 24/62; H01R 2107/00
USPC ..... 439/607.35, 607.36, 74
See application file for complete search history.

(56) References Cited

U.S. PATENT DOCUMENTS 7,207,842 B1 * 4/2007 Kenjo ..... H01R 9/0515 439/607.01
7,585,185 B2 * 9/2009 Obikane ..... H01R 12/52 439/607.01
8,105,112 B2 * 1/2012 Midorikawa ..... H01R 12/716 439/607.35
8,854,835 B2 * 10/2014 Feldstein ..... H01R 12/724 361/818
10,084,265 B2 * 9/2018 Ozeki ..... H01R 12/716
2006/0040559 A1 * 2/2006 Zhang ..... H01R 23/6873 439/607.36
2015/0064942 A1 * 3/2015 Takemoto ..... H01R 12/7029 439/74
2015/0207248 A1 * 7/2015 Takenaga ..... H01R 13/6582 439/74
2017/0033505 A1 * 2/2017 Ozeki ..... H01R 13/5213
2018/0151967 A1 * 5/2018 Chen ..... H01R 13/6581
2018/0175561 A1 * 6/2018 Chen ..... H01R 12/52

FOREIGN PATENT DOCUMENTS

JP 2017033909 A 2/2017

* cited by examiner

*Primary Examiner* — Gary F Paumen
(74) *Attorney, Agent, or Firm* — Rankin, Hill & Clark LLP

(57) ABSTRACT

A connector device including: a plug connector provided with a plurality of plug terminals, a plug housing holding the plurality of plug terminals along a longer direction, and a plug shell held on the plug housing; and a receptacle connector provided with a plurality of receptacle terminals, a receptacle housing holding the plurality of receptacle terminals along the longer direction, and a receptacle shell held on the receptacle housing. The plug shell and the receptacle shell are electrically connected in a state in which the plug connector and the receptacle connector are mated together.

12 Claims, 12 Drawing Sheets

CONNECTOR AND CONNECTOR DEVICE

CROSS-REFERENCE TO RELATED APPLICATION

This application claims priority from Japanese Patent Application No. 2019-000763 filed with the Japan Patent Office on Jan. 7, 2019, the entire content of which is hereby incorporated by reference.

BACKGROUND ART

1. Technical Field

Aspects of the present disclosure relate to a connector and a connector device.

2. Related Art

In an example, a connector device includes a rectangular housing, and a plug-side connector (plug connector) and a receptacle-side connector (receptacle connector) for connecting substrates. In the housing, a plurality of terminals is arranged in two rows in the longer direction by insert molding (integral molding), for example. Such connector device is disclosed in JP-A-2017-033909, for example.

The plug connector and the receptacle connector may be provided on a printed wiring board, a flexible flat cable and the like. For example, it is possible to connect substrates by mating together a receptacle connector surface-mounted on a printed wiring board and a plug connector provided at the end of a flexible flat cable.

In recent years, mobile terminals, such as smartphones, have achieved greater data transmission capacities and faster transmission speeds. Connector devices that are incorporated into such mobile terminals and that include the plug connector and the receptacle connector for connecting substrates are required to be able to accurately transmit high-frequency electric signals at low loss. Accordingly, the transmission between the plug connector and the receptacle connector for transmitting/receiving high-frequency electric signals via the respective terminals needs to satisfy a requirement for characteristics (high-frequency characteristics) with respect to high-frequency signals.

One of the causes that impede the fulfillment of the requirement for the high-frequency characteristics is the so-called electromagnetic interference (EMI) due to, e.g., electromagnetic-wave noise signals generated from the connector terminals. As a conventional example, in the connector device disclosed in JP-A-2017-033909, each of the plug connector and the receptacle connector has a shield wall extending along the longer direction. The shield walls provide an electromagnetic shield function with respect to the electromagnetic-wave noise signals generated from mounting portions (contact connecting portions) disposed at the ends of the terminals of each connector. In this way, the electromagnetic interference is addressed. Specifically, in the conventional connector device, the plug connector and the receptacle connector are arranged such that, when they are mated with each other, the shield walls of the respective connectors are opposed to each other in the connector width direction (shorter direction). In the connector device of the conventional example, the electromagnetic shield function is obtained as the shield walls are doubly arranged on the inside and outside, for example. In this way, an EMI countermeasure is implemented.

SUMMARY

A connector device includes: a plug connector including a plurality of plug terminals, a plug housing holding the plurality of plug terminals along a longer direction, and a plug shell held on the plug housing; and a receptacle connector including a plurality of receptacle terminals, a receptacle housing holding the plurality of receptacle terminals along the longer direction, and a receptacle shell held on the receptacle housing. Each of the plurality of plug terminals includes a contact part contacting a receptacle terminal serving as a counterpart terminal among the plurality of receptacle terminals, and a mounting portion; the plug shell includes a plate-shaped plug shield extending along the longer direction of the plug housing, a support held on the plug housing, and a mounting portion connected to a ground potential of a substrate; the plug shield is opposed to a mounting end, exposed from the plug housing, of each of the plurality of plug terminals in a shorter direction; each of the plurality of receptacle terminals includes a contact part contacting a plug terminal serving as a counterpart terminal among the plurality of plug terminals, and a mounting portion; the receptacle shell includes a plate-shaped receptacle shield extending along the longer direction of the receptacle housing, a support held on the receptacle housing, and a mounting portion connected to a ground potential of a substrate; the receptacle shield is opposed to a mounting end, exposed from the receptacle housing, of each of the plurality of receptacle terminals in the shorter direction; and in a state in which the plug connector and the receptacle connector are mated together, the plug shell and the receptacle shell are electrically connected.

DETAILED DESCRIPTION

Figure 1:
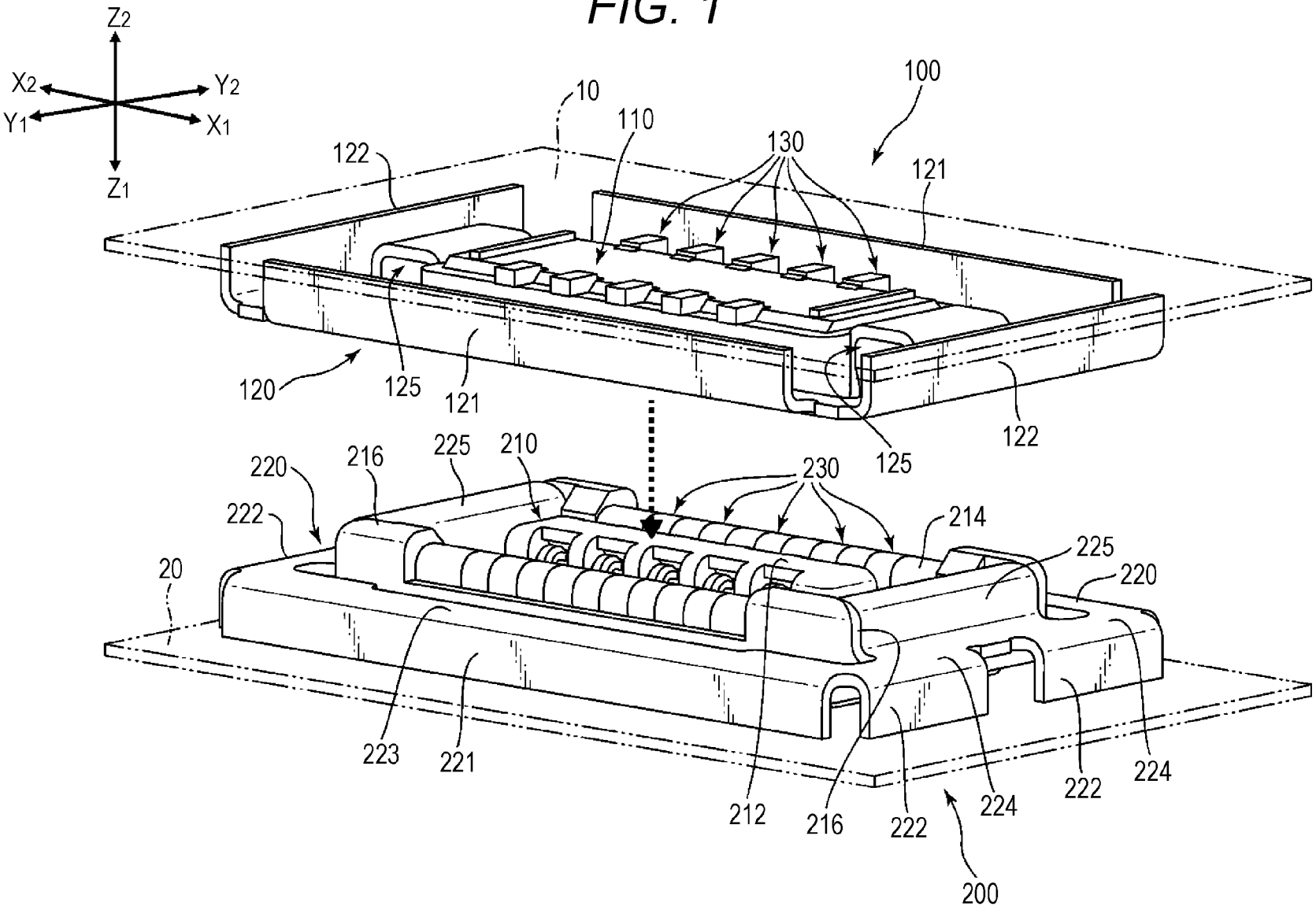
FIG. 1 illustrates a connector device according to a first embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

As electronic apparatuses such as smartphones and mobile terminals have become generally more downsized and capable of providing enhanced functionality, high density mounting of components, such as elements and connectors for connecting substrates, on the printed wiring board is becoming more widespread. There is also a demand for downsizing the connector as a component. However, in the conventional connector device, when the connectors are mated together, the shield walls extending in the longer direction of each connector are arranged doubly on the inside and outside. As a result of the inner/outer dual structure, the width of each connector in the shorter direction increases. This impedes downsizing of the connectors. That is, this impedes reduction of the area occupied by the connector on the substrate, and also impedes high density mounting.

In addition, in the conventional connector device, contact pieces protruding in the lateral direction (horizontal direction with respect to the substrate) are provided on the side surface of the shield walls of one connector. The contact pieces are abutted against the opposing shield walls of the other connector when the connectors are mated together. In this way, the electromagnetic shied effect is obtained. Thus, in the conventional connector device, the inner/outer dual structure of the shield walls is an indispensable configuration. Accordingly, in the conventional connector device, it is difficult to remove the inner/outer dual structure of the shield walls in order to downsize the connectors.

An object of the present disclosure is to provide a connector device as follows. The connector device does not use the inner/outer dual structure of shield walls. The connector device has a plug connector and a receptacle connector. Each of the plug connector and the receptacle connector includes a housing holding a plurality of terminals arranged in a longer direction, and shields provided along the longer direction of the housing. In the connector device, when the connectors are mated together, a shield for electromagnetically shielding the terminals of the plug connector and a shield for electromagnetically shielding the terminals of the receptacle connector are placed in contact with each other and are electrically connected by shield mating portions provided at the ends in the longer direction of each housing. Thus, it is possible to eliminate substantially a potential difference between the shields. As a result, a sufficient electromagnetic shield function can be obtained.

A connector device according to an aspect of the present disclosure (this connector device) includes: a plug connector including a plurality of plug terminals, a plug housing holding the plurality of plug terminals along a longer direction, and a plug shell held on the plug housing; and a receptacle connector including a plurality of receptacle terminals, a receptacle housing holding the plurality of receptacle terminals along the longer direction, and a receptacle shell held on the receptacle housing. Each of the plurality of plug terminals includes a contact part contacting a receptacle terminal serving as a counterpart terminal among the plurality of receptacle terminals, and a mounting portion; the plug shell includes a plate-shaped plug shield extending along the longer direction of the plug housing, a support held on the plug housing, and a mounting portion connected to a ground potential of a substrate; the plug shield is opposed to a mounting end, exposed from the plug housing, of each of the plurality of plug terminals in a shorter direction; each of the plurality of receptacle terminals includes a contact part contacting a plug terminal serving as a counterpart terminal among the plurality of plug terminals, and a mounting portion; the receptacle shell includes a plate-shaped receptacle shield extending along the longer direction of the receptacle housing, a support held on the receptacle housing, and a mounting portion connected to a ground potential of a substrate; the receptacle shield is opposed to a mounting end, exposed from the receptacle housing, of each of the plurality of receptacle terminals in the shorter direction; and in a state in which the plug connector and the receptacle connector are mated together, the plug shell and the receptacle shell are electrically connected.

In a preferred embodiment of the connector device: the plurality of plug terminals are provided along each of two side walls in the longer direction of the plug housing; the plug shell has the plate-shaped plug shields, extending along the longer direction of the plug housing, on both sides; each of the plug shields is opposed to each of the mounting ends of the plurality of plug terminals provided on the two side walls of the plug housing, at an equal interval and in the shorter direction; the plurality of receptacle terminals are provided along the two side walls in the longer direction of the receptacle housing; the receptacle shell has the plate-shaped receptacle shields, extending along the longer direction of the receptacle housing, on both sides; each of the receptacle shields is opposed to each of the mounting ends of the plurality of receptacle terminals provided on the two side walls of the receptacle housing, at an equal interval and in the shorter direction; and in a state in which the plug connector and the receptacle connector are mated together, the plug shell and the receptacle shell are arranged without an overlap in the shorter direction, and the plug shell and the receptacle shell are electrically connected.

In a preferred embodiment of the connector device: the plug shell has plug shell planes extending along the longer direction of the plug housing on both sides; the plug shields include an edge portion of the plug shell that is bent at right angle to the plug shell planes; the receptacle shell has receptacle shell planes extending along the longer direction of the receptacle housing on both sides; the receptacle shield is an edge portion of the receptacle shell that is bent at right angle to the receptacle shell planes; and in a state in which the plug connector and the receptacle connector are mated together, the plug shell planes and the receptacle shell planes are opposed to or are in contact with each other.

In a preferred embodiment of the connector device: each of one shields of the plug shields and the receptacle shields has a shield protrusion extending in a direction for mating with a counterpart connector; each of the other shields of the plug shields and the receptacle shields has a shield cutout for receiving the shield protrusion; and in the state in which the plug connector and the receptacle connector are mated together, the shield protrusion is caught in the shield cutout, with a side surface of the shield protrusion abutting an inner surface of the shield cutout.

In a preferred embodiment of the connector device, the one shield having the shield protrusion has a thickness greater than a thickness of the other shield having the shield cutout.

In a preferred embodiment of the connector device: each of one shields of the plug shields and the receptacle shields has a pair of shield protrusions extending in the direction for mating with a counterpart connector; each of the other shields of the plug shields and the receptacle shields has a pair of points of contact, exposed from the inside of the other shield in the direction for mating with the counterpart connector, to contact the pair of shield protrusions; and each of the pair of points of contact is disposed at an end part of an elastic movable arm extending from a central bend of the other shield toward both ends of the other shield along an inner surface of the other shield.

In a preferred embodiment of the connector device, the movable arm extending toward both ends from the bend of the other shield is formed so as to be bent in the direction for mating with a counterpart connector.

In a preferred embodiment of the connector device: each of one shell planes of the plug shell planes and the receptacle shell planes has a pair of contact pieces; and the pair of contact pieces is formed so as to extend from the one shell plane and be opposed to each other, and so as to be bent in the direction for mating with the counterpart connector.

In a preferred embodiment of the connector device, the pair of contact pieces is provided at two locations on each of the one shell planes.

A connector according to an embodiment of the present disclosure (this connector) includes: a plurality of terminals; and a housing holding the plurality of terminals along a longer direction, and an outer conductor shell held on the housing. Each of the plurality of terminals has a contact part for contacting a counterpart terminal, and a mounting portion; the outer conductor shell has a plate-shaped shield extending along the longer direction of the housing, a support held on the housing, and a mounting portion connected to a ground potential of a substrate; the shield is opposed to a mounting end, exposed from the housing, of each of the plurality of terminals in a shorter direction; and in a state of being mated with a counterpart connector, the outer conductor shell is electrically connected with a counterpart outer conductor shell of the counterpart connector.

In a preferred embodiment of the connector: the plurality of terminals are provided along each of two side walls in the longer direction of the housing; the outer conductor shell has the plate-shaped shield extending in the longer direction of the housing on both sides; each of the shields is opposed to the mounting end of each of the plurality of terminals provided on the two side walls of the housing, at an equal interval and in the shorter direction; and in the state of being mated with the counterpart connector, the outer conductor shell and the counterpart outer conductor shell are arranged without an overlap in the shorter direction, and the outer conductor shell and the counterpart outer conductor shell are electrically connected.

In a preferred embodiment of the connector: the outer conductor shell has shell planes extending in the longer direction of the housing on both sides; and the shields include an edge portion of the outer conductor shell that is bent at right angle to the shell planes.

In a preferred embodiment of the connector: each of the shields disposed on both sides of the housing has a shield protrusion extending in the direction for mating with the counterpart connector; and the shield protrusion is configured such that, in the state of being mated with the counterpart connector, the shield protrusion is caught in a shield cutout provided in a counterpart shield of the counterpart connector, with a side surface of the shield protrusion abutting an inner surface of the shield cutout.

In a preferred embodiment of the connector: each of the shields disposed on both sides of the housing has a shield cutout; and the shield cutout is configured such that, in the state of being mated with the counterpart connector, the shield cutout catches a shield protrusion provided on a counterpart shield of the counterpart connector, with a side surface of the shield protrusion abutting an inner surface of the shield cutout.

In a preferred embodiment of the connector: each of the shields disposed on both sides of the housing has a pair of shield protrusions extending in the direction for mating with the counterpart connector; and each of the pair of shield protrusions is configured such that, in the state of being mated with the counterpart connector, a tip-end of the shield protrusion abuts a counterpart contact provided on the counterpart connector.

In a preferred embodiment of the connector: each of the shields disposed on both sides of the housing has a pair of points of contact exposed from the inside of the shield in the direction for mating with the counterpart connector; the pair of points of contact is disposed at end parts of an elastic movable arm extending from a central bend of the shield along an inner surface of the shield toward both ends of the shield; and the pair of points of contact is configured such that, in the state of being mated with the counterpart connector, the pair of points of contact is in contact with a pair of shield protrusions provided on the counterpart connector.

In a preferred embodiment of the connector: each of the shields disposed on both sides of the housing has a pair of points of contact for contacting a pair of shield protrusions provided on the counterpart connector; the pair of points of contact is disposed at end parts, exposed from a cutout portion formed in the shell planes, of an elastic movable arm extending from a central bend of the shield along an inner surface of the shield toward both ends of the shield; and the pair of points of contact is configured to contact, in the state of being mated with the counterpart connector, the pair of shield protrusions that has entered the inside of the shield through the cutout portion formed in the shell plane.

In a preferred embodiment of the connector, the movable arm extending from the bend of the shield toward both ends is formed so as to be bent in the direction for mating with the counterpart connector.

In a preferred embodiment of the connector: each of the shell planes on both sides of the housing has a pair of contact pieces; and the pair of contact pieces is formed so as to extend from the shell plane and be opposed to each other, and so as to be bent in the direction for mating with the counterpart connector.

In a preferred embodiment of the connector, the pair of contact pieces is provided at two locations on each of the shell planes on both sides of the housing.

In a preferred embodiment of the connector, the connector is a receptacle connector or a plug connector.

In the present connector device and the present connector, when the connectors are mated together, the shield for electromagnetically shielding the terminals of the plug connector and the shield for electromagnetically shielding the terminals of the receptacle connector are in contact with each other and are electrically connected by the shield mating portions provided at the ends in the longer direction of each housing. Thus, it is possible to eliminate substantially the potential difference between the shields. As a result, a sufficient electromagnetic shield function can be obtained. In addition, with the present connector device and the present connector having such configuration, it is possible to avoid the inner/outer dual structure of the shields that impedes downsizing of the connector. Thus, it is possible to reduce the areas occupied by the connectors on the substrates. As a result, the present connector device and the present connector contribute to achieving high density mounting.

In the following, embodiments of the present disclosure will be described with reference to the drawings. Throughout the drawing figures for describing modes of implementation, in principle, similar members are designated with similar signs, and redundant descriptions of the similar members will be omitted. The embodiments are described each independently. However, this does not exclude constructing a connector by combining constituent elements of different embodiments.

FIG. 1 illustrates a connector device according to a first embodiment of the present disclosure. The connector mating direction is the Z1-Z2 direction (Z-axis direction) as shown. A plug connector 100 is mated with a receptacle connector 200, which is on the Z1-side in the Z-axis direction of the counterpart connector. The receptacle connector 200 is mated with the plug connector 100, which is the counterpart connector on the Z2-side in the Z-axis direction. In the present embodiment, the longer direction corresponds to the X1-X2 direction (X-axis direction), and the shorter direction corresponds to the Y1-Y2 direction (Y-axis direction). In FIG. 1, some of a plurality of terminals of each of the plug connector 100 and the receptacle connector 200 are designated with sign "130" or "230", and designation of the other terminals with an identical shape is omitted. This similarly applies to the other drawing figures.

The connector device illustrated in FIG. 1 includes the plug connector 100 and the receptacle connector 200. Each connector may be used as an internal component of, e.g., a small-sized electronic apparatus, such as a mobile phone, a smartphone, a digital camera, or a notebook computer. The same applies to the connectors of the other embodiments described below.

The plug connector 100 and the receptacle connector 200 are mounted on a printed wiring board, a flexible flat cable and the like by soldering. Herein, the object on which the connectors are mounted, such as a printed wiring board or a flexible flat cable, is simply referred to as a "substrate". In the connector device illustrated in FIG. 1, the plug connector 100 is mounted on a plug-side substrate 10 indicated by dashed lines. The receptacle connector 200 is mounted on a receptacle-side substrate 20, indicated by dashed lines. In the connector device, the plug connector, and the receptacle connector illustrated in FIG. 2 and subsequent figures, illustration of the substrates is omitted. The plug connector 100 and the receptacle connector 200 are each configured by molding a housing made from an insulating resin, such as a liquid crystal polymer (LCP), into an oblong shape.

Figure 2:
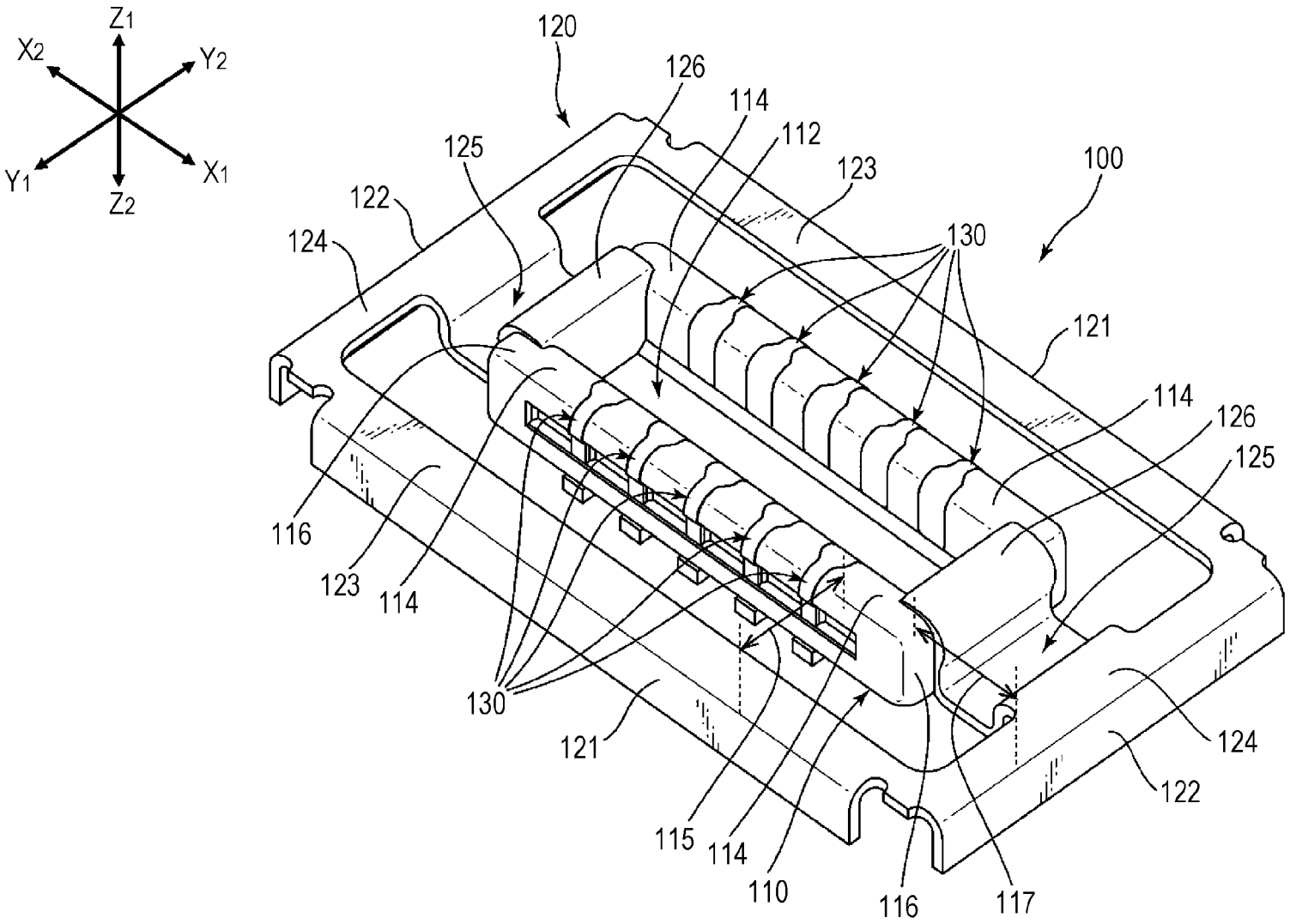
FIG. 2 illustrates a plug connector included in the connector device according to the first embodiment of the present disclosure.

FIG. 2 illustrates the plug connector of the connector device illustrated in FIG. 1. Referring to FIG. 2 together with FIG. 1, the plug connector 100 is provided with a plurality of plug terminals 130, a plug housing 110 holding the plurality of plug terminals 130, and a plug shell 120 held on the plug housing 110. The plug connector 100 is provided with a concave mating recess 112 (see FIG. 2) disposed at the center of the oblong plug housing 110 and extending in the longer direction (X-axis direction). The plug connector 100 is provided with, on both sides (Y1 and Y2-sides) in the shorter direction (Y-axis direction) of the mating recess 112, first side walls 114 holding the plurality of plug terminals 130. The first side walls 114 are provided in two rows along the longer direction (X-axis direction) of the plug connector 100. The mating recess 112 is formed between the two rows of first side walls 114.

The plug housing 110 of the plug connector 100 is insert-molded (integrally molded) with the plurality of identically shaped plug terminals 130, and is able to hold the plurality of plug terminals 130. The plurality of plug terminals 130 is arranged at substantially equal intervals in the longer direction (X-axis direction) in two rows. The plug shell 120, which is the outer conductor, includes plate-shaped first plug shields 121 extending along the longer direction (X-axis direction) of the plug housing 110, and shield connecting portions 125 extending along the side walls in the shorter direction (Y-axis direction) of the plug housing 110. The plug shell 120 is provided with the first plug shields 121 on both sides (Y1-side and Y2-side), one on each side. In the configuration illustrated in FIG. 2, one first plug shield 121 is formed on each side (Y1-side or Y2-side). Instead, the plug shell 120 may have a plurality of shields formed by dividing a single shield. The first plug shields 121 have surfaces parallel to the X-Z plane, and are arranged across a range greater than first side walls 214 (see FIG. 3) in the longer direction (X-axis direction).

The plug shell 120 also includes second plug shields 122, in addition to the first plug shields 121. The plug shell 120 has the plate-shaped second plug shields 122 extending along the shorter direction (Y-axis direction) of the plug housing 110 and disposed on both sides (X1-side and X2-side), one on each side. In the configuration illustrated in FIG. 2, one second plug shield 122 is formed on each side (Y1-side or Y2-side). Instead, the plug shell 120 may have a plurality of shields formed by dividing a single shield. Ends of the first plug shields 121 and ends of the second plug shields 122 provide mounting portions for mounting to a ground portion (not illustrated) of the substrate, so that the plug shell 120 can be at a ground potential (earth potential). The second plug shields 122 include surfaces parallel to the Y-Z plane, and are arranged across a range greater than the first side walls 114 in the longer direction (X-axis direction). In a state in which the plug connector 100 and the receptacle connector 200 are mated together, the plug shell 120 is electrically connected with a receptacle shell 220 (see FIG. 3), which is the counterpart outer conductor shell.

The plug housing 110 is surrounded (on the X-Y plane) by the first plug shields 121 and the second plug shields 122 respectively via a first interval 115 and a second interval 117. The first interval 115 is the interval from the first side walls 114 of the plug housing 110 to the first plug shields 121. The second interval 117 is the interval from the second side walls 116 of the plug housing 110 to the second plug shields 122. The first side walls 114 and the first plug shields 121 are parallel to each other, and the second side walls 116 and the second plug shields 122 are parallel to each other. Therefore, the first interval 115 and the second interval 117 are respectively substantially constant values. The first plug shields 121 are opposed, at an equal interval in the shorter direction (Y-axis direction), to mounting ends 131 (see FIG. 4) which are the ends, exposed from the plug housing 110, of the respective mounting portions 132 of the plurality of plug terminals 130.

The plug shell 120 is provided with first plug shell planes 123, extending along the longer direction (X-axis direction) of the plug housing 110, on both sides (Y1-side and Y2-side), one on each side. The first plug shields 121 are the edge portions of the plug shell 120 bent at right angle to the first plug shell planes 123. The plug shell 120 also is provided with second plug shell planes 124 which extend along the shorter direction (Y-axis direction) of the plug housing 110, and which are disposed on both sides (X1-side and X2-side), one on each side. The second plug shields 122 are the edge portions of the plug shell 120 bent at right angle to the second plug shell planes 124. In the configuration illustrated in FIG. 2, one first plug shell plane 123 and one second plug shell plane 124 is formed on each side (Y1-side or Y2-side). Instead, the plug shell 120 may have a plurality of shell planes formed by dividing a single shell plane. The first plug shell planes 123 and the second plug shell planes 124 include X-Y planes.

The plug shell 120 includes, in portions extending from the center of each of the second plug shell planes 124 toward the mating recess 112, shield connecting portions 125 and plug housing supports 126. The shield connecting portions 125 are positioned between the second side walls 116 extending in the shorter direction (Y-axis direction) of the plug housing 110, and the plug shell 120. Specifically, the shield connecting portions 125 are positioned between the plug housing supports 126, which grip and fix the side walls of the plug housing 110 on the inside of the plug shell 120, and the second plug shell planes 124. In the embodiment illustrated in FIG. 1 and FIG. 2, the shield connecting portions 125 have a concave shape. However, the shape of the shield connecting portions 125 is not limited to the concave shape, and may be a convex shape. The shield connecting portions 125 may have any shape as long as the shield connecting portions 125 can be mated with receptacle housing supports 225 (see FIG. 3) of the receptacle connector 200.

The plug housing supports 126 are respectively provided on the second side walls 116 on both sides (X1-side and X2-side) in the longer direction (X-axis direction) of the plug housing 110. The plug housing supports 126 extend in the shorter direction (Y-axis direction) along the second side walls 116. The plurality of plug terminals 130 is made of a metal, such as phosphor bronze, as the primary component. The plurality of plug terminals 130 are provided on the two first side walls 114 in the longer direction (X-axis direction) of the plug housing 110, and are arranged at regular intervals. The mating recess 112 is formed so as to be surrounded on four sides by the side walls (second side walls 116 and first side walls 114) of the plug housing 110.

Figure 3:
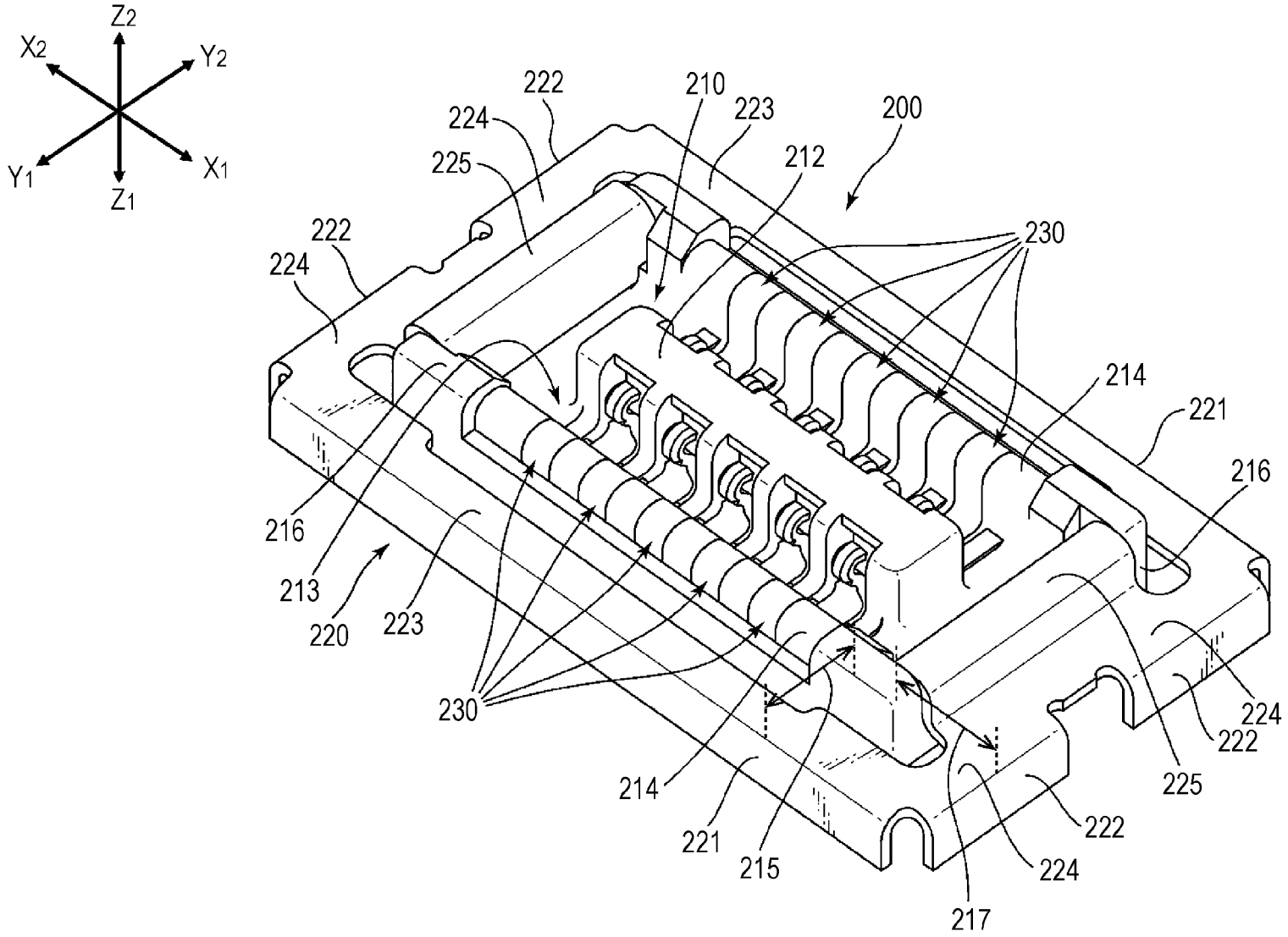
FIG. 3 illustrates a receptacle connector included in the connector device according to the first embodiment of the present disclosure.

FIG. 3 illustrates the receptacle connector of the connector device illustrated in FIG. 1. Referring to FIG. 3 together with FIG. 1, the receptacle connector 200 includes a plurality of receptacle terminals 230, a receptacle housing 210 holding the plurality of receptacle terminals 230, and a receptacle shell 220 held on the receptacle housing 210. The receptacle connector 200 is provided with, at the center of the oblong receptacle housing 210, a convex mating projection 212 extending in the longer direction (X-axis direction). The receptacle connector 200 is provided with, on both sides (Y1 and Y2-sides) in the shorter direction (Y-axis direction) of the mating projection 212, first side walls 214 holding the plurality of receptacle terminals 230. The first side walls 214 are provided in two rows along the longer direction (X-axis direction) of the receptacle connector 200. The mating projection 212 is formed between the two rows of first side walls 214. A mating space 213 is formed between the mating projection 212 and the two rows of first side walls 214. The mating space 213 is mated with the two rows of first side walls 114 of the plug connector 100. The mating space 213 is the space between the mating projection 212 and the first side walls 214 and second side walls 216 that surround the four sides of the mating projection 212.

The receptacle housing 210 of the receptacle connector 200 is insert-molded (integrally molded) with the plurality of identically shaped receptacle terminals 230, and is able to hold the plurality of receptacle terminals 230. The plurality of receptacle terminals 230 is arranged at substantially equal intervals in the longer direction (X-axis direction) in two rows. The receptacle shell 220, which is the outer conductor, includes plate-shaped first receptacle shields 221 extending along the longer direction (X-axis direction) of the receptacle housing 210, and receptacle housing supports 225 extending along the second side walls 216 in the shorter direction (Y-axis direction) of the receptacle housing 210. The receptacle housing supports 225 are held on the receptacle housing 210. The receptacle shell 220 is provided with the first receptacle shields 221 on both sides (Y1-side and Y2-side), one on each side. In the configuration illustrated in FIG. 3, one first receptacle shield 221 is formed on each side (Y1-side or Y2-side). Instead, the receptacle shell 220 may have a plurality of shields formed by dividing a single shield. The first receptacle shields 221 include surfaces parallel to the X-Z plane.

The receptacle shell 220 also includes second receptacle shields 222, in addition to the first receptacle shields 221. The receptacle shell 220 has the plate-shaped second receptacle shields 222 extending along the shorter direction (Y-axis direction) of the receptacle housing 210 and disposed on both sides (X1-side and X2-side), two on each side. In the embodiment illustrated in FIG. 1 and FIG. 3, the second receptacle shields 222 are split in two on each side (Y1-side or Y2-side). Instead, one shield may be formed. Alternatively, a plurality of shields may be formed by dividing a single shield. Ends of the first receptacle shields 221 and ends of the second receptacle shields 222 provide mounting portions for mounting onto a ground portion (not illustrated) of the substrate, so that the receptacle shell 220 can be at a ground potential (earth potential). The second receptacle shields 222 include surfaces parallel to the Y-Z plane, and are arranged across a range greater than the first side walls 214 in the longer direction (X-axis direction). In a state in which the plug connector 100 and the receptacle connector 200 are mated together, the receptacle shell 220 is electrically connected with the plug shell 120, which is the counterpart outer conductor shell.

The receptacle housing 210 is surrounded (on the X-Y plane) by the first receptacle shields 221 and the second receptacle shields 222 respectively via a first interval 215 and a second interval 217. The first interval 215 is the interval from the first side walls 214 of the receptacle housing 210 to the first receptacle shields 221. The second interval 217 is the interval from the second side walls 216 of the receptacle housing 210 to the second receptacle shields 222. The first side walls 214 and the first receptacle shields 221 are parallel to each other, and the second side walls 216 and the second receptacle shields 222 are parallel to each other. Accordingly, each of the first interval 215 and the second interval 217 is a substantially constant value. The first receptacle shields 221 are opposed, at an equal interval in the shorter direction (Y-axis direction), to mounting ends 231 (see FIG. 4) which are the ends, exposed from the receptacle housing 210, of the respective mounting portions 232 of the plurality of receptacle terminals 230.

The receptacle shell 220 is provided with first receptacle shell planes 223, extending along the longer direction (X-axis direction) of the receptacle housing 210, on both sides (Y1-side and Y2-side), one on each side. The first receptacle shields 221 are the edge portions of the receptacle shell 220 that are bent at right angle to the first receptacle shell planes 223. The receptacle shell 220 also is provided with second receptacle shell planes 224 which extend along the shorter direction (Y-axis direction) of the receptacle housing 210, and which are disposed on both sides (X1-side and X2-side), one on each side. The second receptacle shields 222 are the edge portions of the receptacle shell 220 that are bent at right angle to the second receptacle shell planes 224. In the configuration illustrated in FIG. 3, one first receptacle shell plane 223 and one second receptacle shell plane 224 are respectively formed on each side (Y1-side or Y2-side). Instead, the receptacle shell 220 may include a plurality of shell planes formed by dividing a single shell plane. The first receptacle shell planes 223 and the second receptacle shell planes 224 include X-Y planes.

The receptacle shell 220 includes, in portions extending from the center of each of the second receptacle shell planes 224 toward the mating projection 212, receptacle housing supports 225. The receptacle housing supports 225 are provided respectively along the second side walls 216 disposed on both sides (X1-side and X2-side) in the longer direction (X-axis direction) of the receptacle housing 210. The receptacle housing supports 225 respectively extend along the second side walls 216 in the shorter direction (Y-axis direction) of the receptacle housing 210. The receptacle housing supports 225 grip the second side walls 216 and thereby fix the receptacle housing 210 on the inside of the receptacle shell 220. In the embodiment illustrated in FIG. 1 and FIG. 3, the receptacle housing supports 225 have a convex shape. However, the shape of the receptacle housing supports 225 is not limited to the convex shape. The shape of the receptacle housing supports 225 may be a concave shape. The receptacle housing supports 225 may have any shape as long as the receptacle housing supports 225 can be mated with the shield connecting portions 125 of the plug connector 100.

The plurality of receptacle terminals 230 is made of a metal, such as phosphor bronze, as the primary component. The plurality of receptacle terminals 230 is provided on the two first side walls 214 and are arranged at regular intervals in the longer direction (X-axis direction) of the receptacle housing 210. The mating projection 212 is formed so as to be surrounded on four sides by the first side walls 214 and the second side walls 216 of the receptacle housing 210.

Figure 4:
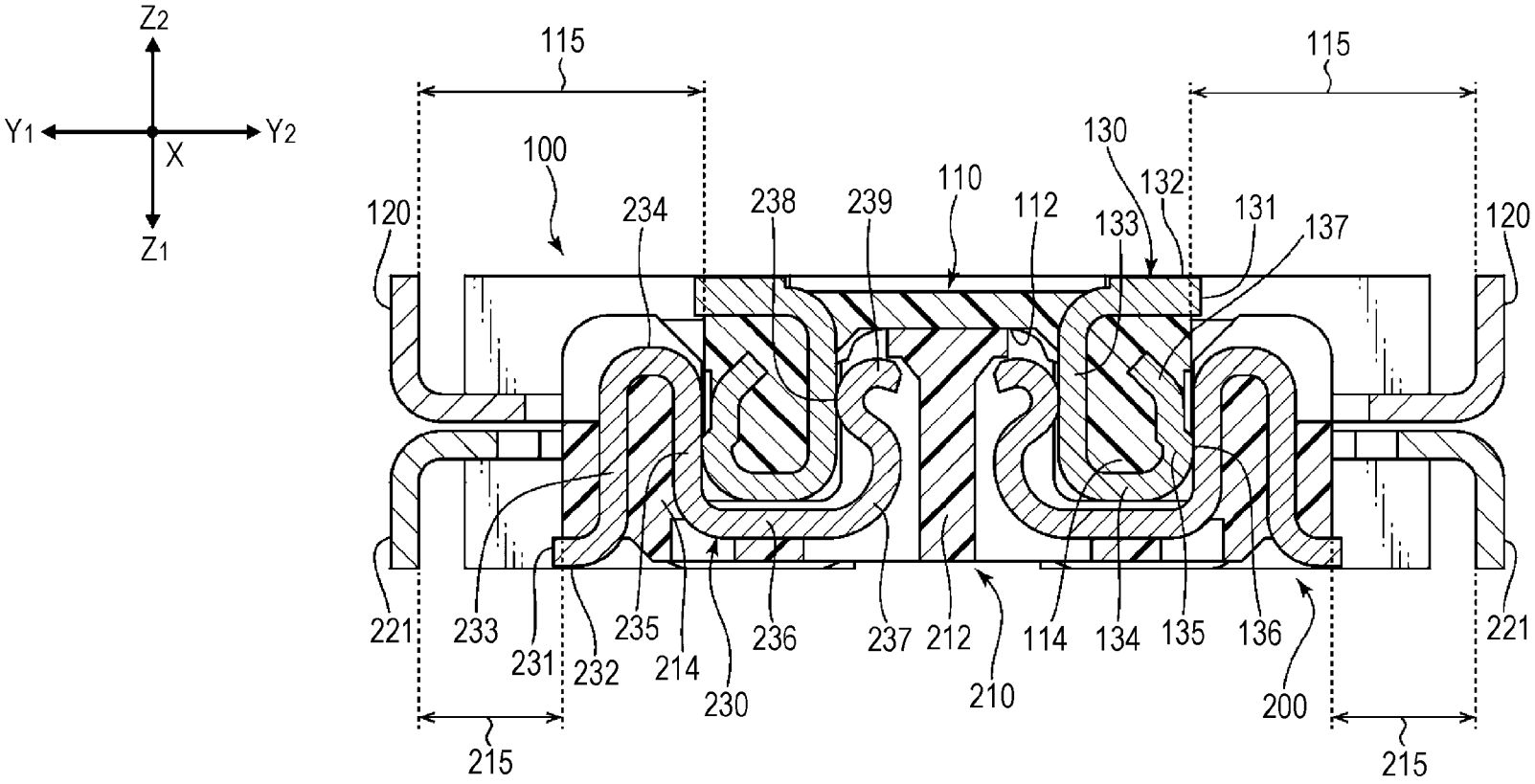
FIG. 4 is a cross sectional view illustrating how the terminals are in contact with each other in a state in which the plug connector and the receptacle connector illustrated in FIG. 1 are mated together.

FIG. 4 is a cross sectional view illustrating how the terminals are in contact with each other in a state in which the plug connector and the receptacle connector of FIG. 1 are mated together. In the state in which the plug connector 100 and the receptacle connector 200 are electrically connected, the mating projection 212 of the receptacle housing 210 enters the mating recess 112 of the plug housing 110 and is mated therewith.

The plug terminals 130 include a portion curved in substantially U-shape having an inner fixing part 133, a top part 134, and an outer fixing part 135. The inner fixing part 133 and the outer fixing part 135 are formed in positions opposing each other on the inside of the plug terminals 130. The plug terminals 130 are held on the plug housing 110 in such a way that the first side walls 114 in the longer direction (X-axis direction) of the plug connector 100 are enclosed by the mounting portions 132, the inner fixing part 133, the top part 134, the outer fixing part 135, and an embedded part 137. Thus, resin is present in or fills the gap between the inner fixing part 133 and the outer fixing part 135, i.e., the inside of the plug terminals 130.

The plug terminals 130 have the mounting portions 132 on the side (Z2-side) mounted to the substrate. The mounting portions 132 extend from the inner fixing part 133 via a curved part to the outside in the shorter direction (Y-axis direction) of the plug connector 100, and are mounted (soldered) to the substrate. The outside in the shorter direction (Y-axis direction) is the Y2-side when the inner fixing part 133 is on the Y1-side, and the Y1-side when the inner fixing part 133 is on the Y2-side.

The mounting ends 131 at the ends of the mounting portions 132 are opposed to the first plug shields 121 in the shorter direction (Y-axis direction). The mounting ends 131 of the plug terminals 130 held by the first side wall 114 on one side (for example, Y1-side) of the plug housing 110 are opposed to the first plug shield 121 on the same side (Y1-side) in the shorter direction (Y-axis direction). The mounting ends 131 of the plug terminals 130 held by the first side wall 114 on the other side (for example, Y2-side) of the plug housing 110 are opposed to the first plug shield 121 on the same side (Y2-side) in the shorter direction (Y-axis direction). Further, in the state in which the plug connector 100 and the receptacle connector 200 are mated together, the plug shell 120 and the receptacle shell 220 are arranged without an overlap in the shorter direction (Y-axis direction). Further, in this state, the plug shell 120 and the receptacle shell 220 are electrically connected. Herein, being "arranged in the shorter direction (Y-axis direction) without an overlap" means that the plug shell 120 and the receptacle shell 220 are arranged so as not to include the state in which the plug shell and the receptacle shell (shields) are opposed to and in contact with each other in the shorter direction (Y-axis direction).

Referring to FIG. 2 in addition to FIG. 4, due to the insert molding of the plug terminals 130 and the plug housing 110, the inner fixing part 133 and the top part 134 of the plug terminals 130 are embedded in the first side walls 114 in such a way that the side surface of the inner fixing part 133 and the side surface of the top part 134 are substantially flush with the surface of the first side walls 114. The end part of the outer fixing part 135 is also embedded in the first side walls 114 as the embedded part 137. The outer fixing part 135 is provided with a contact part 136 for contacting the receptacle terminals 230, which are the counterpart terminals. The contact part 136 is formed so as to protrude toward the outside in the shorter direction (Y-axis direction). The outside in the shorter direction (Y-axis direction) is the Y1-side when the inner fixing part 133 is on the Y1-side, and the Y2-side when the inner fixing part 133 is on the Y2-side.

A surface of the inner fixing part 133 of the plug terminals 130 functions as a contact part for contacting the receptacle terminals 230, and is able to contact, with a contact pressure, a contact part 238 of the receptacle terminals 230. The contact part 136 of the outer fixing part 135 of the plug terminals 130 is able to contact a fixing part 235 of the receptacle terminals 230.

As illustrated in FIG. 4, the receptacle terminals 230 include a movable part 237 on the mating projection 212 side. The movable part 237 is a free end extending in the direction (Z-axis direction) for mating with the counterpart connector, and has elasticity. The movable part 237 includes a contact part 238 that contacts the inner fixing part 133 of the plug terminals 130, and a movable end 239 closer to the end than the contact part 238 and facing the mating projection 212 side. The receptacle terminals 230 also include a top part 234, a leg part 233, and a fixing part 235. The top part 234 is held on the first side walls 214 in the longer direction (X-axis direction) of the receptacle connector 200. The leg part 233 and the fixing part 235 constitute a portion formed in vertically inverted U-shape with the top part 234 at the center. The fixing part 235 and the movable part 237 constitute a portion formed in U-shape with a bottom part 236 at the center.

The receptacle terminals 230 have the mounting portions 232 on the side (Z1-side) mounted to the substrate. The mounting portions 232 extend from the leg part 233 via a curved portion to the outside in the shorter direction (Y-axis direction) of the receptacle connector 200, and are mounted (soldered) to the substrate. The outside in the shorter direction (Y-axis direction) of the receptacle connector 200 is the Y1-side when the leg part 233 is on the Y1-side, and the Y2-side when the leg part 233 is on the Y2-side.

The mounting ends 231, which are the ends of the mounting portions 232, are opposed to the first receptacle shields 221 in the shorter direction (Y-axis direction). The mounting ends 231 of the receptacle terminals 230 held by the first side wall 114 on one side (for example, Y1-side) of the receptacle housing 210 are opposed to the first receptacle shield 221 on the same side (Y1-side) in the shorter direction (Y-axis direction). The mounting ends 231 of the receptacle terminals 230 held by the first side wall 214 on the other side (for example, Y2-side) of the receptacle housing 210 are opposed to the first receptacle shield 221 on the same side (Y2-side) in the shorter direction (Y-axis direction).

Referring to FIG. 3 in addition to FIG. 4, due to the insert molding of the receptacle terminals 230 and the receptacle housing 210, the bottom part 236, the fixing part 235, the top part 234, and the leg part 233 of the receptacle terminals 230 are held by the first side walls 214 in the longer direction (X-axis direction) of the receptacle housing 210 and by portions around the first side walls 214. Of the receptacle terminals 230, the back surface (surface opposing the first side walls 214) of the top part 234, the back surface (surface opposing the leg part 233) of the fixing part 235, and the back surface (surface opposing the fixing part 235) of the leg part 233 are embedded in and held by the first side walls 214 in such a way that the surface of the vertically inverted U-shaped portion that is exposed from the first side walls 214 is flush with the surface of the first side walls 214.

The movable part 237 of the receptacle terminals 230 includes, at a tip-end thereof, a contact part 238 formed so as to protrude toward the fixing part 235. The contact part 238, in the state in which the plug connector 100 and the receptacle connector 200 are mated together (state of being mated with the plug connector 100), is able to contact, with a contact pressure, the inner fixing part 133 of the plug terminals 130. Of the receptacle terminals 230, the surface of the fixing part 235 on the movable part 237 side, in the state of being mated with the plug connector 100, is configured to be able to contact, with a contact pressure, the convex contact part 136 of the plug terminals 130.

When the plug connector 100 and the receptacle connector 200 illustrated in FIG. 1 are electrically connected as illustrated in FIG. 4, the shield connecting portions 125 and the receptacle housing supports 225 are in the state of being mated together. The shield connecting portions 125 extend along the second side walls 116 in the shorter direction (Y-axis direction) of the plug housing 110. The receptacle housing supports 225 extend along the second side walls 216 in the shorter direction (Y-axis direction) of the receptacle housing 210. Thus, the first plug shields 121 and the first receptacle shields 221 are electrically connected. In the state in which the shield connecting portions 125 and the receptacle housing supports 225 are mated together, the first plug shell planes 123 and the first receptacle shell planes 223 are opposed to or are in contact with each other in the mating direction (Z-axis direction). Further, the second plug shell planes 124 and the second receptacle shell planes 224 similarly are opposed to or are in contact with each other.

Due to the configuration described above, in the connector device and the connector according to the first embodiment, when the connectors are mated together, the first plug shields 121 for electromagnetically shielding the plug terminals 130 of the plug connector 100, and the first receptacle shields 221 for electromagnetically shielding the receptacle terminals 230 of the receptacle connector 200 are in contact with each other and are electrically connected by the shield connecting portions 125 and the receptacle housing supports 225 which are disposed at the ends on both sides (X1-side and X2-side) in the longer direction (X-axis direction) of the plug housing 110 and receptacle housing 210. Thus, the potential difference between the shields can be substantially eliminated, and a sufficient electromagnetic shield function can be obtained.

A similar electromagnetic shield function can be obtained by the first plug shell planes 123 and the first receptacle shell planes 223 opposing or contacting each other, and the second plug shell planes 124 and the second receptacle shell planes 224 opposing or contacting each other.

As illustrated in FIG. 4, in the plug connector 100, the mounting ends 131 and the first plug shields 121 are opposed to each other via the first interval 115, which is the space provided between the mounting ends 131 and the first plug shields 121. In this way, it is possible to block electromagnetic waves generated around the mounting portions 132, and to well block leakage of the electromagnetic waves to the outside of the plug connector 100. Similarly, in the receptacle connector 200, the mounting ends 231 and the first receptacle shields 221 are opposed to each other via the first interval 215, which is the space provided between the mounting ends 231 and the first receptacle shields 221. In this way, it is possible to block electromagnetic waves generated around the mounting portions 232, and to well block leakage of the electromagnetic waves to the outside of the receptacle connector 200. That is, even when a high-frequency coaxial signal or differential signal is transmitted to the plug terminals 130 and the receptacle terminals 230, a sufficient electromagnetic shield function can be obtained because leakage of electromagnetic waves from the connector device is substantially eliminated.

In addition, due to the configuration described above, in the connector device and the connector according to the present embodiment, the plug shield and the receptacle shield do not overlap in the shorter direction (Y-axis direction). Thus, it is possible to avoid the inner/outer dual structure of the shields that impedes downsizing of the connectors. Accordingly, it is possible to reduce the area occupied by the connector on the substrate, and to contribute to achieving high density mounting. These functional effects can be similarly obtained in the other embodiments which will be described below.

In the present description, in order to distinguish the two connectors included in the connector device, the terms "plug connector" and "receptacle connector" are used. Further, various members, components and the like are distinguished by using the terms such as "plug housing and receptacle housing", "plug terminal and receptacle terminal", and "plug shell and receptacle shell". However, when they are not distinguished, the words "plug" and "receptacle" will be omitted, and they will simply be referred to as "connector", "housing", "terminal", and "shell" (or "outer conductor shell"), for example. The first plug shield and the first receptacle shield may be respectively referred to simply as "plug shield" and "receptacle shield". Further, when the connectors are not distinguished by shape, the first plug shield and the first receptacle shield will be referred to simply as "shields".

Figure 5:
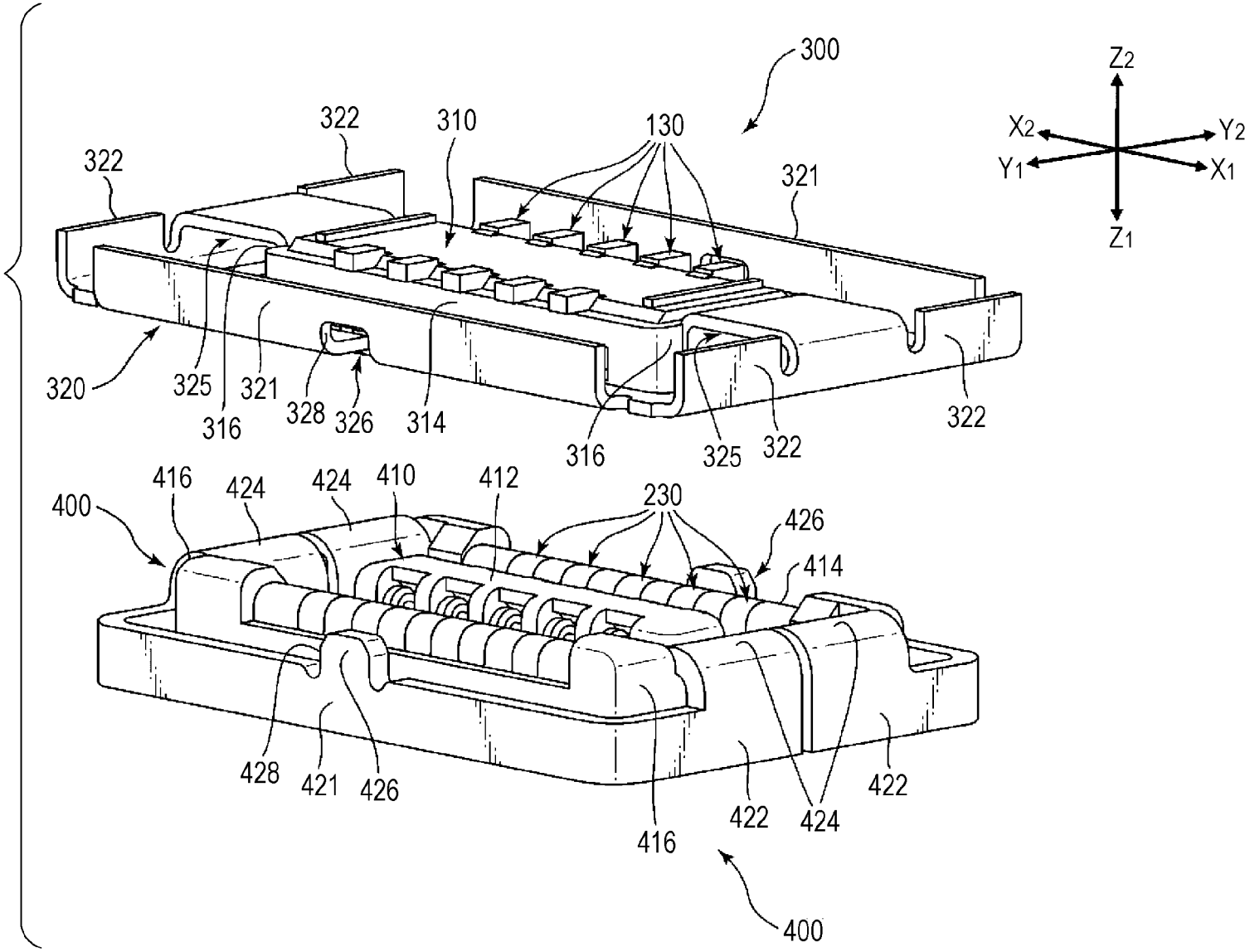
FIG. 5 illustrates a connector device according to a second embodiment of the present disclosure.
Figure 6:
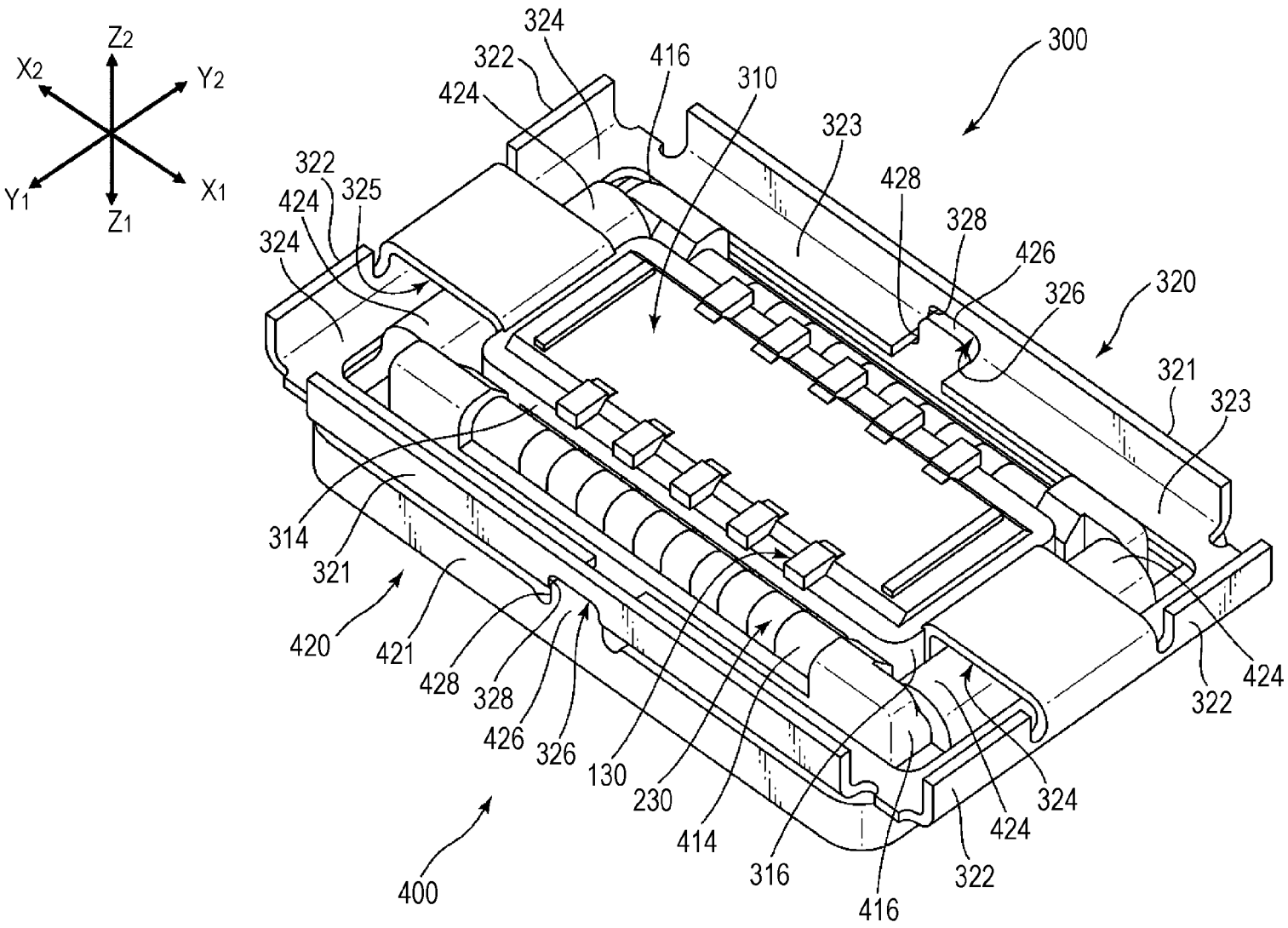
FIG. 6 illustrates the connector device according to the second embodiment of the present disclosure, where the plug connector and the receptacle connector are mated together.

FIG. 5 illustrates a connector device according to a second embodiment of the present disclosure. FIG. 6 illustrates a state in which the plug connector and the receptacle connector illustrated in FIG. 5 are mated together. The connector device illustrated in FIG. 5 and FIG. 6 includes a plug connector 300 and a receptacle connector 400. The basic configurations of the plug connector 300 and the receptacle connector 400 are similar to those of the plug connector 100 and the receptacle connector 200 according to the first embodiment.

The plug connector 300 is provided with a plurality of plug terminals 130, a plug housing 310 holding the plurality of plug terminals 130, and a plug shell 320 held on the plug housing 310. The basic configuration of the plug housing 310 is the same as that of the plug housing 110 according to the first embodiment, for example.

The plug housing 310 of the plug connector 300 is insert-molded (integrally molded) with the plurality of identically shaped plug terminals 130, and is capable of holding the plurality of plug terminals 130. The plurality of plug terminals 130 is arranged at substantially equal intervals in the longer direction (X-axis direction) in two rows. The plug shell 320, which is the outer conductor, has plate-shaped first plug shields 321 which extend along the longer direction (X-axis direction) of the plug housing 310 and which are opposed to first side walls 314, and plug mating portions 325 which extend along second side walls 316 in the shorter direction (Y-axis direction) of the plug housing 310. The plug shell 320 is provided with the first plug shields 321 on both sides (Y1-side and Y2-side), one on each side.

The plug shell 320 also includes, in addition to the first plug shields 321, second plug shields 322. The plug shell 320 has the second plug shields 322, which have a plate shape, extending along the shorter direction (Y-axis direction) of the plug housing 310 and disposed on both sides (X1-side and X2-side), two on each side.

The plug shell 320 is provided with first plug shell planes 323 extending along the longer direction (X-axis direction) of the plug housing 310 and disposed on both sides (Y1-side and Y2-side), one on each side. The plug shell 320 is also provided with second plug shell planes 324 which extend along the shorter direction (Y-axis direction) of the plug housing 310 and which are disposed on both sides (X1-side and X2-side), one on each side.

The receptacle connector 400 is provided with a plurality of receptacle terminals 230, a receptacle housing 410 holding the plurality of receptacle terminals 230, and a receptacle shell 420 held on the receptacle housing 410. The basic configuration of the receptacle housing 410 is the same as that of the receptacle housing 210 according to the first embodiment, for example.

The receptacle housing 410 of the receptacle connector 400 is insert-molded (integrally molded) with the plurality of identically shaped receptacle terminals 230, and is able to hold the plurality of receptacle terminals 230. The plurality of receptacle terminals 230 is arranged at substantially equal intervals in the longer direction (X-axis direction) in two rows. The receptacle shell 420, which is the outer conductor, has plate-shaped first receptacle shields 421 extending along the longer direction (X-axis direction) of the receptacle housing 410, and receptacle mating portions 424 extending along second side walls 416 in the shorter direction (Y-axis direction) of the receptacle housing 410. The receptacle shell 420 has the first receptacle shields 421 on both sides (Y1-side and Y2-side), one on each side.

In the embodiment illustrated in FIG. 5, the receptacle mating portions 424 are divided in two. Instead, a single receptacle mating portion may be formed. Alternatively, a single receptacle mating portion may be divided to form a plurality of receptacle mating portions.

The receptacle shell 420 includes, in addition to the first receptacle shields 421, second receptacle shields 422. The receptacle shell 420 has the plate-shaped second receptacle shields 422 extending along the shorter direction (Y-axis direction) of the receptacle housing 410 and disposed on both sides (X1-side and X2-side), two on each side.

The receptacle shell 420 is provided with receptacle shield protrusions 426 each at the center of the first receptacle shields 421. The receptacle shield protrusions 426 extend from the first receptacle shields 421 in the mating direction (Z-axis direction) toward the counterpart connector (Z2-side). The receptacle shell 420 of the second embodiment is not provided with a configuration equivalent to the first receptacle shell planes 223 and the second receptacle shell planes 224 illustrated in FIG. 1 and FIG. 3. However, this is not a limitation, and the receptacle shell 420 of the second embodiment may be provided with first and second receptacle shell planes.

Each of the first plug shields 321 disposed on both sides of the plug housing 310 has a plug shield cutout 326 at the center. The plug shield cutouts 326 are used to accept the receptacle shield protrusions 426 of the first receptacle shields 421 of the receptacle connector 400, which is the counterpart connector. The plug shield cutouts 326 have inner surfaces (inner wall surfaces on both sides in the longer direction (X-axis direction) of the plug housing 310) that form points 328 of contact with the receptacle shield protrusions 426. Side walls of the receptacle shield protrusions 426 form points 428 of contact with the plug shield cutouts 326. The first receptacle shields 421 may be formed such that the thickness of the first receptacle shields 421 with the receptacle shield protrusions 426 is greater than the thickness of the first plug shields 321 with the plug shield cutouts 326.

Thus, in the embodiment illustrated in FIG. 5, in the state in which the plug connector 300 and the receptacle connector 400 are mated together, the receptacle shield protrusions 426 are caught in the plug shield cutouts 326, with the side surfaces of the receptacle shield protrusions 426 abutting the inner surfaces of the plug shield cutouts 326. That is, the plug shield cutouts 326 are configured such that, in the state in which the plug connector 300 and the receptacle connector 400 are mated together, the plug shield cutouts 326 catch the receptacle shield protrusions 426 provided on the first receptacle shields 421 of the receptacle connector 400, with the side surfaces of the receptacle shield protrusions 426 abutting the inner surfaces of the plug shield cutouts 326.

In the second embodiment illustrated in FIG. 5 and FIG. 6, the plug shield cutouts 326 are provided in the plug connector 300, and the receptacle shield protrusions 426 are provided in the receptacle connector 400. However, this is not a limitation, and the shield cutouts may be provided in the receptacle connector, and the shield protrusions may be provided in the plug connector. In the following embodiments, it is also possible to exchange the configuration of the plug connector and the configuration of the receptacle connector.

Figure 7:
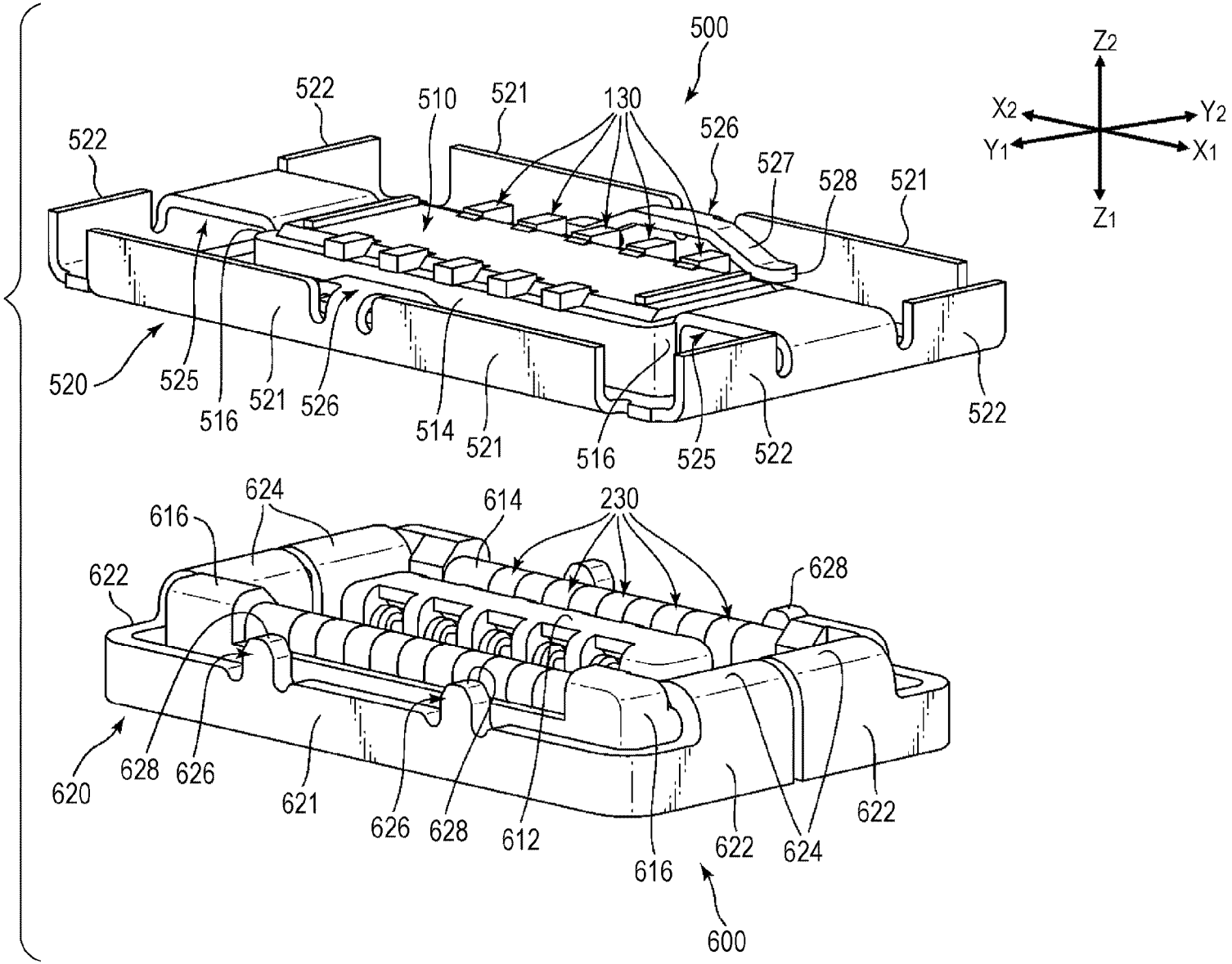
FIG. 7 illustrates a connector device according to a third embodiment of the present disclosure.
Figure 8:
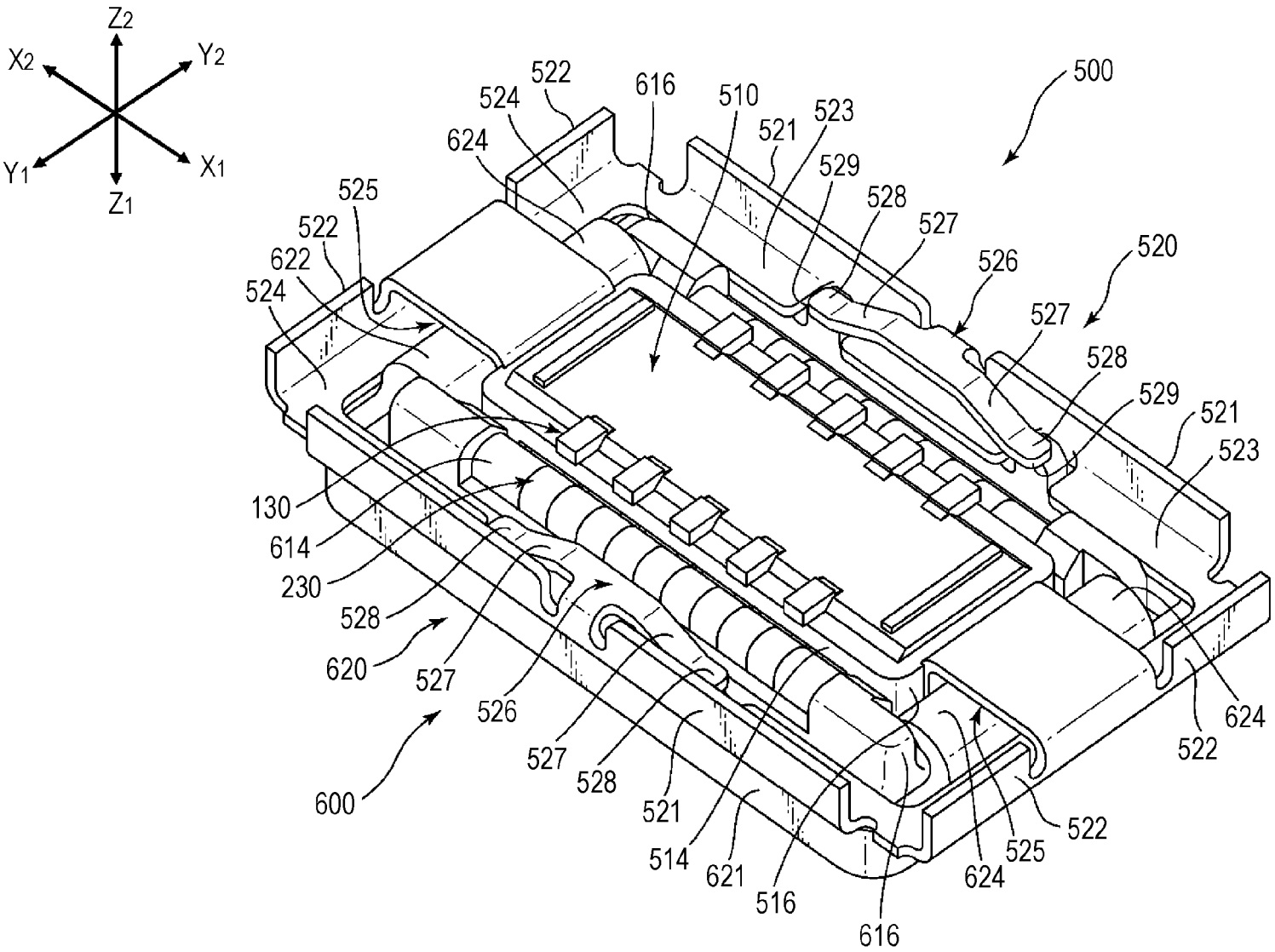
FIG. 8 illustrates the connector device according to the third embodiment of the present disclosure, where the plug connector and the receptacle connector are mated together.

FIG. 7 illustrates a connector device according to a third embodiment of the present disclosure. FIG. 8 illustrates the state in which the plug connector and the receptacle connector illustrated in FIG. 7 are mated together. The connector device illustrated in FIG. 7 and FIG. 8 includes a plug connector 500 and a receptacle connector 600. The basic configurations of the plug connector 500 and the receptacle connector 600 are similar to the basic configurations of the plug connector 100 and the receptacle connector 200 according to the first embodiment, and are similar to the basic configurations of the plug connector 300 and the receptacle connector 400 according to the second embodiment.

The plug connector 500 is provided with a plurality of plug terminals 130, a plug housing 510 holding the plurality of plug terminals 130, and a plug shell 520 held on the plug housing 510. The basic configuration of the plug housing 510 is the same as that of the plug housing 310 according to the third embodiment, for example.

The plug housing 510 of the plug connector 500 is insert-molded (integrally molded) with the plurality of identically shaped plug terminals 130, and is capable of holding the plurality of plug terminals 130. The plurality of plug terminals 130 is arranged at equal intervals in the longer direction (X-axis direction) in two rows. The plug shell 520, which is the outer conductor, has plate-shaped first plug shields 521 extending along the longer direction (X-axis direction) of the plug housing 510, and shield connecting portions 525 extending along second side walls 516 in the shorter direction (Y-axis direction) of the plug housing 510. The plug shell 520 is provided with the first plug shields 521 on both sides (Y1-side and Y2-side), one on each side.

The plug shell 520 includes, in addition to the first plug shields 521, second plug shields 522. The plug shell 520 has the plate-shaped second plug shields 522 extending along the shorter direction (Y-axis direction) of the plug housing 510 and disposed on both sides (X1-side and X2-side), two on each side.

The plug shell 520 is provided with first plug shell planes 523 which extend along the longer direction (X-axis direction) of the plug housing 510 and which are disposed on both sides (Y1-side and Y2-side), one on each side. The plug shell 520 is also provided with second plug shell planes 524 which extend along the shorter direction (Y-axis direction) of the plug housing 510 and which are disposed on both sides (X1-side and X2-side), one on each side.

The receptacle connector 600 is provided with a plurality of receptacle terminals 230, a receptacle housing 610 holding the plurality of receptacle terminals 230, and a receptacle shell 620 held on the receptacle housing 610. The basic configuration of the receptacle housing 610 is the same as that of the receptacle housing 410 according to the third embodiment, for example.

The receptacle housing 610 of the receptacle connector 600 is insert-molded (integrally molded) with the plurality of identically shaped receptacle terminals 230, and is able to hold the plurality of receptacle terminals 230. The plurality of receptacle terminals 230 is arranged at equal intervals in the longer direction (X-axis direction) in two rows. The receptacle shell 620, which is the outer conductor, has plate-shaped first receptacle shields 621 which extend along the longer direction (X-axis direction) of the receptacle housing 610 and which are opposed to first side walls 514, and receptacle housing supports 624 which extend along second side walls 616 in the shorter direction (Y-axis direction) of the receptacle housing 610. The receptacle shell 620 is provided with the first receptacle shields 621 on both sides (Y1-side and Y2-side), one on each side.

The receptacle shell 620 also includes, in addition to the first receptacle shields 621, second receptacle shields 622. The receptacle shell 620 has the plate-shaped second receptacle shields 622 extending along the shorter direction (Y-axis direction) of the receptacle housing 610 and disposed on both sides (X1-side and X2-side), two on each side.

The receptacle shell 620 is provided with pairs of receptacle shield protrusions 626 extending from the first receptacle shields 621 toward the counterpart connector (Z2-side) in the mating direction (Z-axis direction). In the receptacle shell 620 according to the third embodiment, each of the two first receptacle shields 621 is provided with a pair of receptacle shield protrusions 626. However, this is not a limitation, and the number of the receptacle shield protrusions may be increased or decreased, as appropriate, in accordance with the number of points of contact with the outer conductor shell of the counterpart connector (plug shell of the plug connector), or the width of the counterpart connector in the longer direction (X-axis direction), for example.

Each of the first plug shields 521 provided on both sides of the plug housing 510 has a pair of points 529 of contact (counterpart points of contact). The pair of points 529 of contact is used to contact the pair of receptacle shield protrusions 626 of each of the first receptacle shields 621 of the receptacle connector 600, which is the counterpart connector. The first plug shields 521 are each provided with a bend 526. The bend 526 is bent toward the inside from the central edge portion. The "inside" is the Y2-side in the case of the first plug shield 521 on the Y1-side, or the Y1-side in the case of the first plug shield 521 on the Y2-side. The pairs of points 529 of contact are disposed on movable ends 528. The movable ends 528 are the end parts of an elastic movable arm 527, which extends from the bend 526 at the center of the first plug shields 521, along the inner surface of the first plug shields 521 (the surface of the first plug shields 521 opposing the plug housing 510), toward both ends of the first plug shields 521 (X-axis direction). The movable arm 527 is formed so as to be bent toward the counterpart connector (Z2-side) in the direction (Z-axis direction) for mating with the receptacle connector 600, which is the counterpart connector.

In the plug shell 520 according to the third embodiment, each of the two first plug shields 521 is provided with one bend 526 having the movable arm 527 with the movable ends 528. However, this is not a limitation, and the number of the bends 526 having the movable arm 527 with the movable ends 528 may be increased or decreased, as appropriate, in accordance with the number of the shield protrusions of the counterpart connector (receptacle shield protrusions of the receptacle connector), or the width of the counterpart connector in the longer direction (X-axis direction), for example.

The movable ends 528 of the movable arm 527 are exposed on the receptacle connector 600 side (Z1-side) in the mating direction (Z-axis direction), from cutout portions formed in the first plug shell planes 523. The pairs of points 529 of contact, in the state in which the shield connecting portions 525 and the receptacle housing supports 624 are mated together, contact the pairs of receptacle shield protrusions 626 that have entered the inside of the first plug shields 521 through the cutout portions formed in the first plug shell planes 523. The respective tip-ends of the pairs of receptacle shield protrusions 626 constitute points 628 of contact with the points 529 of contact of the pairs of movable ends 528. As the receptacle shield protrusions 626 enter the inside of the first plug shields 521, small parts could potentially arise in which the plug shell 520 and the receptacle shell 620 are opposed to each other in the shorter direction (Y-axis direction). However, the receptacle shield protrusions 626 and the points 529 of contact are not likely to result in a state of opposing and contacting each other in the shorter direction (Y-axis direction). The receptacle shield protrusions 626 and the points 529 of contact will simply result in a state of opposing and contacting each other in the longer direction (X-axis direction). It follows, then, that the potential arising of small parts in which the plug shell 520 and the receptacle shell 620 are opposed to each other in the shorter direction (Y-axis direction), due to the entry of the receptacle shield protrusions 626 into the inside of the first plug shields 521, does not contradict the plug shell 520 and the receptacle shell 620 being arranged without an overlap in the shorter direction (Y-axis direction) in the present embodiment.

Figure 9:
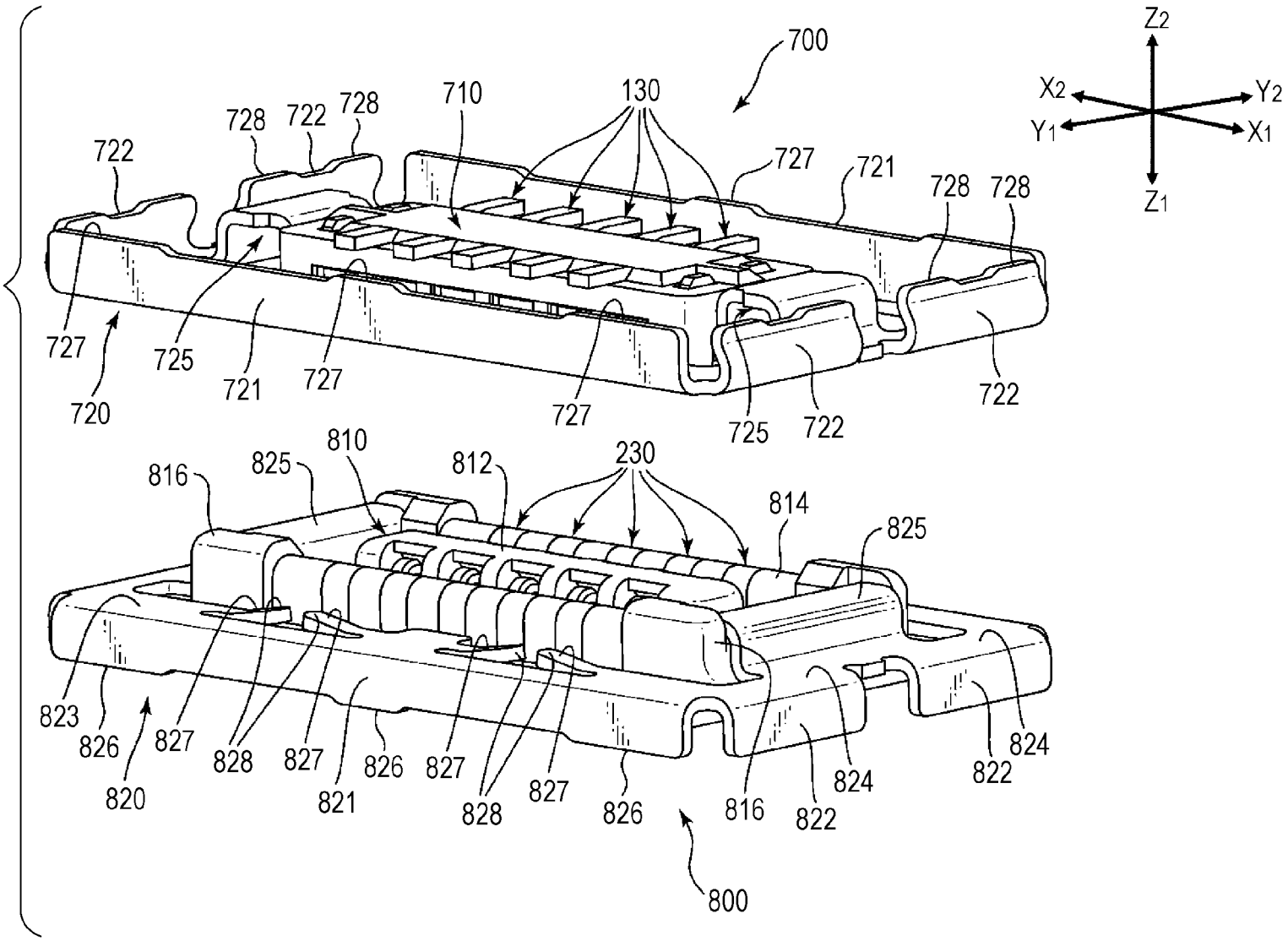
FIG. 9 illustrates a connector device according to a fourth embodiment of the present disclosure.
Figure 10:
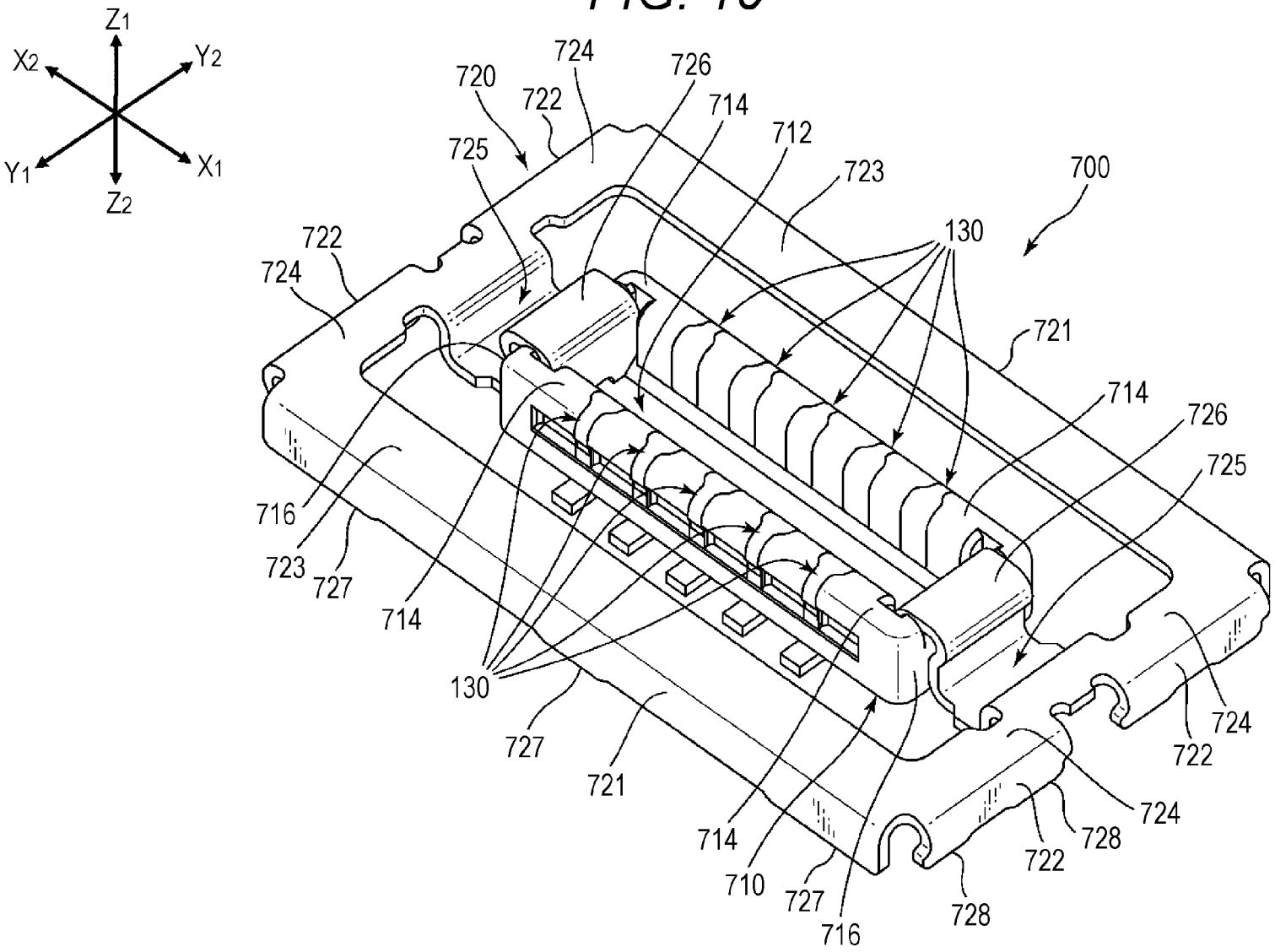
FIG. 10 illustrates a plug connector included in the connector device according to the fourth embodiment of the present disclosure.
Figure 11:
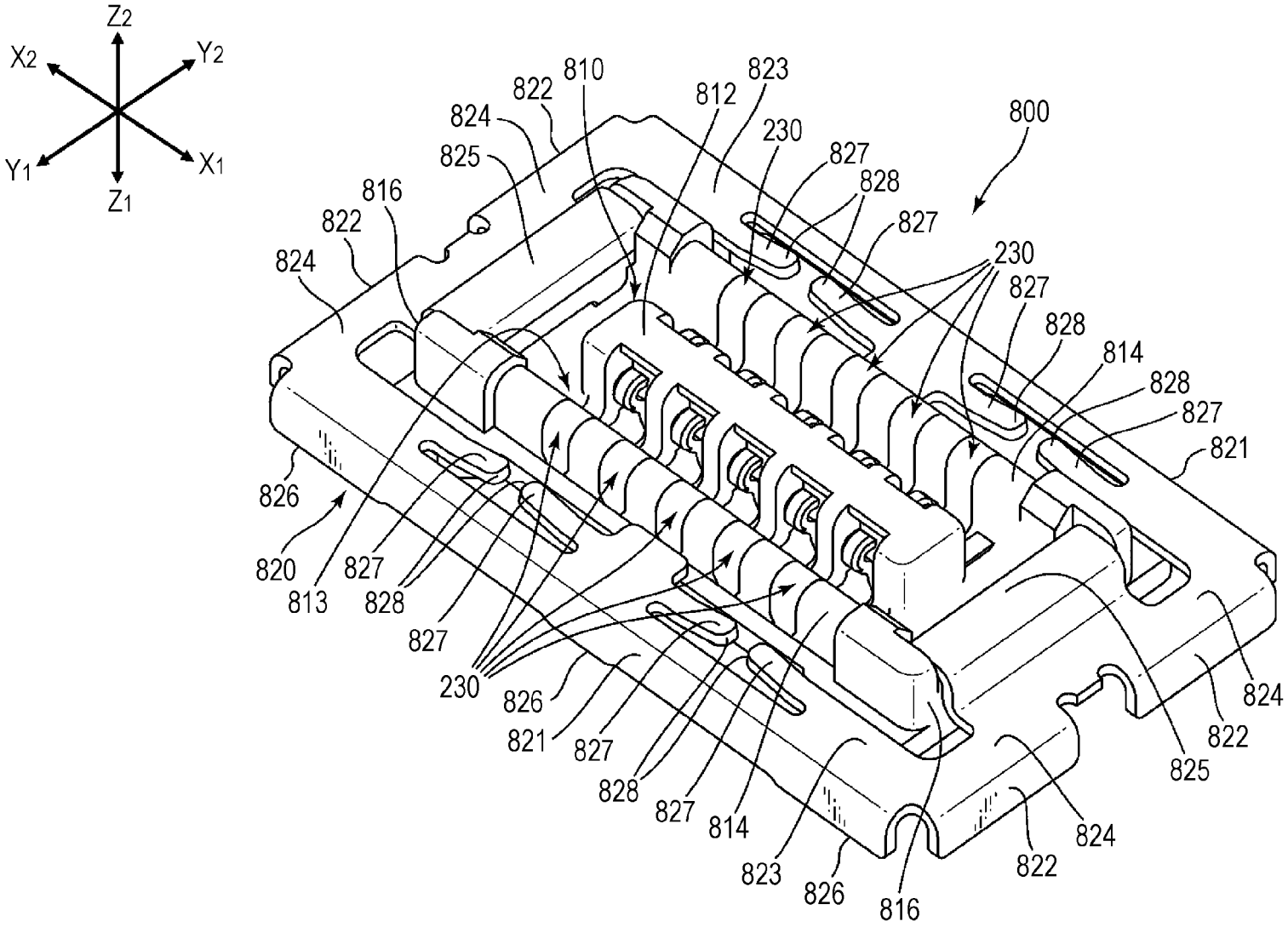
FIG. 11 illustrates a receptacle connector included in the connector device according to the fourth embodiment of the present disclosure.
Figure 12:
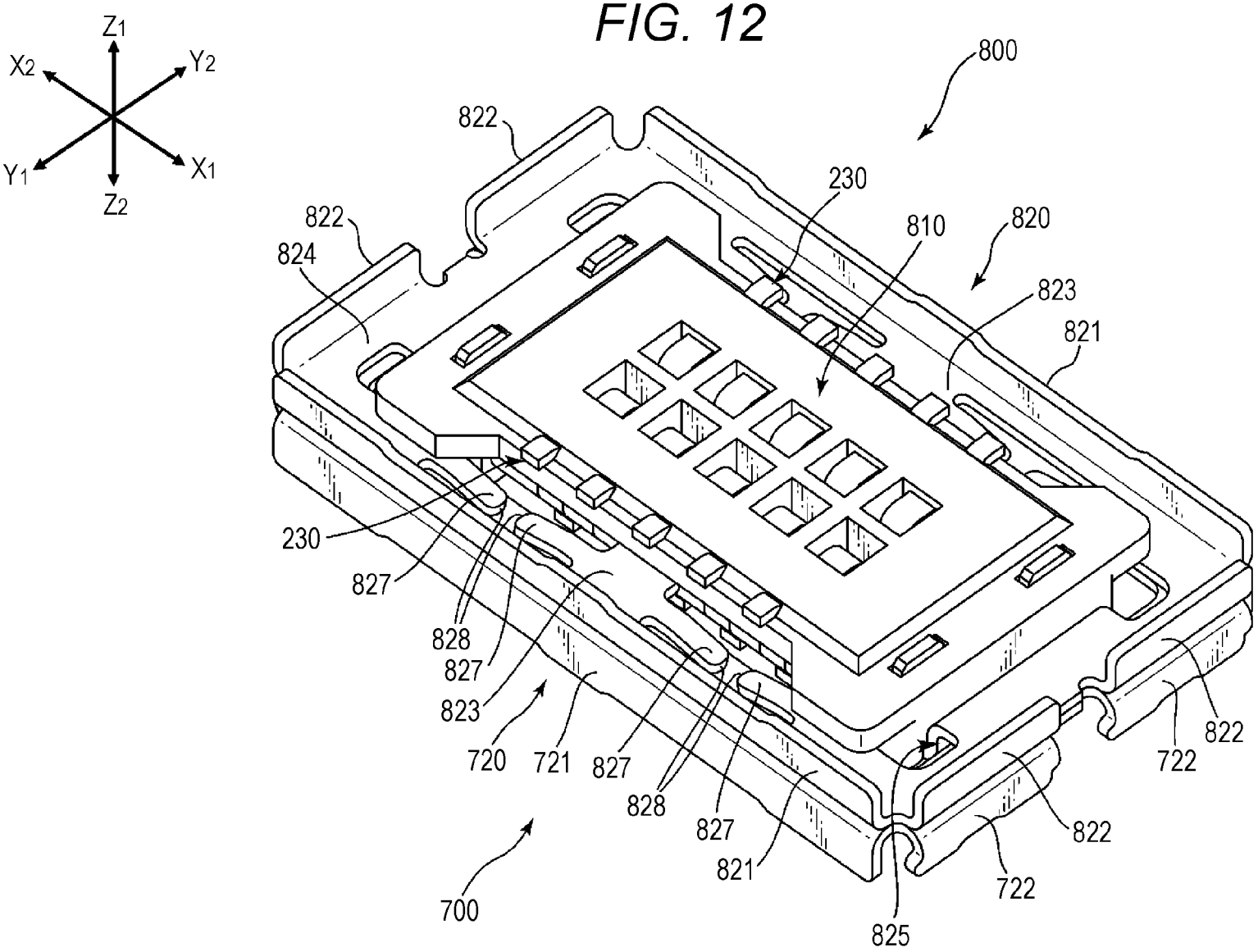
FIG. 12 illustrates the connector device according to the fourth embodiment of the present disclosure, where the plug connector and the receptacle connector are mated together.

FIG. 9 illustrates a connector device according to a fourth embodiment of the present disclosure. FIG. 10 and FIG. 11 respectively illustrate the plug connector and the receptacle connector of the connector device illustrated in FIG. 9. FIG. 12 illustrates the state in which the plug connector and the receptacle connector illustrated in FIG. 9 are mated together. The connector device illustrated in FIG. 9 and FIG. 12 includes the plug connector 700 illustrated in FIG. 10 and the receptacle connector 800 illustrated in FIG. 11. The basic configurations of the plug connector 700 and the receptacle connector 800 are similar to those of the plug connector 100 and the receptacle connector 200 according to the first embodiment, those of the plug connector 300 and the receptacle connector 400 according to the second embodiment, and those of the plug connector 500 and the receptacle connector 600 according to the third embodiment.

The plug connector 700 is provided with a plurality of plug terminals 130, a plug housing 710 holding the plurality of plug terminals 130, and a plug shell 720 held on the plug housing 710. The basic configuration of the plug housing 710 is the same as that of the plug housing 110 according to the first embodiment, for example.

Referring to FIG. 9 and FIG. 10, the plug connector 700 is provided with a concave mating recess 712 (see FIG. 10) extending in the longer direction (X-axis direction) at the center of the oblong plug housing 710. On both sides (Y1 and Y2-sides) in the shorter direction (Y-axis direction) of the mating recess 712, first side walls 714 are provided, each holding a plurality of plug terminals 130. The first side walls 714 are provided along the longer direction (X-axis direction) of the plug connector 700 in two rows. The mating recess 712 is formed between the two rows of first side walls 714.

The plug housing 710 of the plug connector 700 is insert-molded (integrally molded) with the plurality of identically shaped plug terminals 130, and is capable of holding the plurality of plug terminals 130. The plug terminals 130 are arranged at equal intervals in the longer direction (X-axis direction) in two rows. The plug shell 720, which is the outer conductor, has plate-shaped first plug shields 721 extending along the longer direction (X-axis direction) of the plug housing 710, and shield connecting portions 725 extending along second side walls 716 in the shorter direction (Y-axis direction) of the plug housing 710. The plug shell 720 is provided with the first plug shields 721 on both sides (Y1-side and Y2-side), one on each side. The edge portions of the first plug shields 721 may be provided with one or more first plug mounting portions 727 mounted (soldered) to the substrate.

The plug shell 720 also includes, in addition to the first plug shields 721, second plug shields 722. The plug shell 720 is provided with the plate-shaped second plug shields 722 extending along the shorter direction (Y-axis direction) of the plug housing 710 and disposed on both sides (X1-side and X2-side), two on each side. The edge portions of the second plug shields 722 may be provided with one or more first plug mounting portions 728 mounted (soldered) to the substrate.

The plug shell 720 is provided with first plug shell planes 723 which extend along the longer direction (X-axis direction) of the plug housing 710 and which are disposed on both sides (Y1-side and Y2-side), one on each side. The plug shell 720 is also provided with second plug shell planes 724 which extend along the shorter direction (Y-axis direction) of the plug housing 710 and which are disposed on both sides (X1-side and X2-side), one on each side.

The plug shell 720 includes, in portions extending from the center of each of the second plug shell planes 724 toward the mating recess 712, shield connecting portions 725 and plug housing supports 726. The shield connecting portions 725 are positioned between the second side walls 716, extending in the shorter direction (Y-axis direction) of the plug housing 710, and the plug shell 720. Specifically, the shield connecting portions 725 are positioned between the plug housing supports 726, which grip and fix the second side walls 716 of the plug housing 710 on the inside of the plug shell 720, and the second plug shell planes 724.

The plug housing supports 726 are respectively disposed on the second side walls 716 on both sides (X1-side and X2-side) in the longer direction (X-axis direction) of the plug housing 710. The plug housing supports 726 extend along the second side walls 716 in the shorter direction (Y-axis direction). The plurality of plug terminals 130 is provided on the two first side walls 714 in the longer direction (X-axis direction) of the plug housing 710, and is arranged at regular intervals. The mating recess 712 is formed so as to be surrounded on four sides by the first side walls 714 and the second side walls 716 of the plug housing 710.

Referring to FIG. 9 and FIG. 11, the receptacle connector 800 is provided with a plurality of receptacle terminals 230, a receptacle housing 810 holding the plurality of receptacle terminals 230, and a receptacle shell 820 held on the receptacle housing 810. The basic configuration of the receptacle housing 810 is the same as that of the receptacle housing 210 according to the first embodiment.

The receptacle connector 800 is provided with a convex mating projection 812 extending in the longer direction (X-axis direction) at the center of the receptacle housing 810, which has an oblong shape. On both sides (Y1 and Y2-sides) in the shorter direction (Y-axis direction) of the mating projection 812, first side walls 814 each holding a plurality of receptacle terminals 230 are provided. Two rows of first side walls 814 are provided along the longer direction (X-axis direction) of the receptacle connector 800. The mating projection 812 is formed between the two rows of first side walls 814. A mating space 813 is formed between the mating projection 812 and the two rows of first side walls 814. The mating space 813 is mated with the two rows of first side walls 714 of the plug connector 700. The mating space 813 is the space surrounding the four sides of the mating projection 812 and disposed between the mating projection 812 and the first side walls 814 and second side walls 816.

The receptacle housing 810 of the receptacle connector 800 is insert-molded (integrally molded) with the plurality of identically shaped receptacle terminals 230, and is able to hold the plurality of receptacle terminals 230. The plurality of receptacle terminals 230 is arranged at equal intervals in the longer direction (X-axis direction) in two rows. The receptacle shell 820, which is the outer conductor, has plate-shaped first receptacle shields 821 extending along the longer direction (X-axis direction) of the receptacle housing 810, and receptacle mating portions 825 extending along the second side walls 816 in the shorter direction (Y-axis direction) of the receptacle housing 810. The receptacle shell 820 is provided with the first receptacle shields 821 on both sides (Y1-side and Y2-side), one on each side. The edge portions of the first receptacle shields 821 may be provided with one or more receptacle mounting portions 826 mounted (soldered) to the substrate.

The receptacle shell 820 also includes, in addition to the first receptacle shields 821, second receptacle shields 822. The receptacle shell 820 is provided with the plate-shaped second receptacle shields 822 extending along the shorter direction (Y-axis direction) of the receptacle housing 810 and disposed on both sides (X1-side and X2-side), two on each side.

The receptacle shell 820 is provided with first receptacle shell planes 823 which extend in the longer direction (X-axis direction) of the receptacle housing 810 and which are disposed on both sides (Y1-side and Y2-side), one on each side. The receptacle shell 820 is also provided with second receptacle shell planes 824 which extend along the shorter direction (Y-axis direction) of the receptacle housing 810 and which are disposed on both sides (X1-side and X2-side), one on each side.

The receptacle shell 820 is provided with, in the first receptacle shell planes 823, pairs of contact pieces 827 opposing each other in the longer direction (X-axis direction). Each pair of contact pieces 827 extend from the first receptacle shell planes 823 and are formed so as to oppose each other. Specifically, the pairs of contact pieces 827 are formed along the longer direction (X-axis direction). The contact pieces 827 on one side (for example, X1-side) extend toward the other side (for example, X2-side). The contact pieces 827 on the other side (for example, X2-side) opposing the contact pieces 827 on the one side extend toward the one side (for example, X1-side).

The pairs of contact pieces 827 are formed so as to be bent from the first receptacle shell planes 823 toward the counterpart connector (Z2-side) in the mating direction (Z-axis direction). In the receptacle shell 820 according to the fourth embodiment, the pairs of contact pieces 827 are provided at two locations on each of the two first receptacle shell planes 823. However, this is not a limitation, and the number of the contact pieces 827 may be increased or decreased, as appropriate, in accordance with the size of the shell planes of the outer conductor shell of the counterpart connector (the plug shell planes of the plug shell of the plug connector), and the width of the counterpart connector in the longer direction (X-axis direction), for example.

As illustrated in FIG. 12, in the state in which the plug connector 700 and the receptacle connector 800 are mated together, the respective tip-ends of the pairs of contact pieces 827, provided at two locations on each of the first receptacle shell planes 823, constitute points 828 of contact that contact the first plug shell planes 723 of the plug connector 700, which is the counterpart connector.

In the connector devices and the connectors according to the second through the fourth embodiments (FIG. 5 to FIG. 12), which are modifications of the first embodiment (FIG. 1 to FIG. 4), as in the first embodiment, when the connectors are mated together, the plug shields electromagnetically shielding the plug terminals of the plug connector, and the receptacle shields electromagnetically shielding the receptacle terminals of the receptacle connector are in contact with each other in the shorter direction (Y-axis direction) of the connectors and are electrically connected by the shield connecting portions and the receptacle housing supports. In addition, the plug shields and the receptacle shields are in contact with each other, via a plurality of points of contact, in the longer direction (X-axis direction) of the connectors, and are electrically connected, by the shield protrusions provided on the receptacle shields, or by the contact pieces provided on the receptacle shell planes. Thus, it is possible to substantially eliminate the potential difference between the shields and to obtain a sufficient electromagnetic shield function more than is possible in the connector device according to the first embodiment.

Further, as in the first embodiment, in the connector devices and the connectors according to the second through the fourth embodiments, the plug shields and the receptacle shields do not overlap in the shorter direction (Y-axis direction). Thus, it is possible to avoid the inner/outer dual structure of the shields that impedes downsizing of the connectors. Accordingly, it is possible to reduce the areas occupied by the connectors on the substrates, and to contribute to achieving high density mounting. The individual embodiments of the present disclosure are not independent from each other and may be combined and implemented, as appropriate.

In the present description, the expressions "parallel" and "right angle" include not only "parallel" and "right angle" in a strict sense, but also include substantially "parallel" and "right angle".

The technology according to an aspect of the present disclosure may be said to relate to a connector device for connecting substrates, the connector device including a plug connector and a receptacle connector suitable for high-speed transmission of electric signals. Specifically, the technology according to an aspect of the present disclosure may be said to relate to a shield structure of each connector of the connector device. The shield structure is capable of blocking high-frequency electromagnetic-wave noise signals generated from the terminals of each connector when the plug connector and the receptacle connector are mated together and electrically connected.

The connector according to an aspect the present disclosure may be utilized for purposes such as connecting substrates using a flat cable in an electronic apparatus for performing high-speed transmission of electric signals, such as smartphones and mobile phones.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector device comprising:

a plug connector including a plurality of plug terminals, a plug housing holding the plurality of plug terminals provided along each of two side walls in a longer direction of the plug housing, and a plug shell held on the plug housing; and a receptacle connector including a plurality of receptacle terminals, a receptacle housing holding the plurality of receptacle terminals provided along two side walls in a longer direction of the receptacle housing, and a receptacle shell held on the receptacle housing, wherein:

each of the plurality of plug terminals includes a contact part contacting a receptacle terminal serving as a counterpart terminal among the plurality of receptacle terminals, and a mounting portion;

the plug shell includes plate-shaped plug shields extending along the longer direction of the plug housing on both sides, a support held on the plug housing, and a mounting portion connected to a ground potential of a substrate;

each of the plug shields is opposed to each of mounting ends, exposed from the plug housing, of the plurality of plug terminals provided on the two side walls of the plug housing, at an equal interval and in a shorter direction;

each of the plurality of receptacle terminals includes a contact part contacting a plug terminal serving as a counterpart terminal among the plurality of plug terminals, and a mounting portion;

the receptacle shell includes plate-shaped receptacle shields extending along the longer direction of the receptacle housing on both sides, a support held on the receptacle housing, and a mounting portion connected to a ground potential of a substrate;

each of the receptacle shields is opposed to each of mounting ends, exposed from the receptacle housing, of the plurality of receptacle terminals provided on the two side walls of the receptacle housing at an equal interval and in the shorter direction;

the plug shell has plug shell planes extending along the longer direction of the plug housing on both sides;

the plug shields include edge portions of the plug shell that are bent at right angle to the plug shell planes;

the receptacle shell has receptacle shell planes extending along the longer direction of the receptacle housing on both sides;

the receptacle shield is an edge portion of the receptacle shell that is bent at right angle to the receptacle shell planes; and in a state in which the plug connector and the receptacle connector are mated together, the plug shell and the receptacle shell are electrically connected and the plug shell planes and the receptacle shell planes are opposed to or are in contact with each other.

2. The connector device according to claim 1, wherein:

in a state in which the plug connector and the receptacle connector are mated together, the plug shell and the receptacle shell are arranged without an overlap in the shorter direction.

3. The connector device according to claim 1, wherein:

each of first shell planes among the plug shell planes and the receptacle shell planes has a pair of contact pieces; and the pair of contact pieces is formed so as to extend from the first shell plane and be opposed to each other, and so as to be bent in the direction for mating with a counterpart connector.

4. The connector device according to claim 3, wherein the pair of contact pieces is provided at two locations on each of the first shell planes.

5. A connector device comprising:

a plug connector including a plurality of plug terminals, a plug housing holding the plurality of plug terminals provided along each of two side walls in a longer direction of the plug housing, and a plug shell held on the plug housing; and a receptacle connector including a plurality of receptacle terminals, a receptacle housing holding the plurality of receptacle terminals provided along two side walls in a longer direction of the receptacle housing, and a receptacle shell held on the receptacle housing, wherein:

each of the plurality of plug terminals includes a contact part contacting a receptacle terminal serving as a counterpart terminal among the plurality of receptacle terminals, and a mounting portion;

the plug shell includes plate-shaped plug shields extending along the longer direction of the plug housing on both sides, a support held on the plug housing, and a mounting portion connected to a ground potential of a substrate;

each of the plug shields is opposed to each of mounting ends, exposed from the plug housing, of the plurality of plug terminals provided on the two side walls of the plug housing, at an equal interval and in a shorter direction;

each of the plurality of receptacle terminals includes a contact part contacting a plug terminal serving as a counterpart terminal among the plurality of plug terminals, and a mounting portion;

the receptacle shell includes plate-shaped receptacle shields extending along the longer direction of the receptacle housing on both sides, a support held on the receptacle housing, and a mounting portion connected to a ground potential of a substrate;

each of the receptacle shields is opposed to each of mounting ends, exposed from the receptacle housing, of the plurality of receptacle terminals provided on the two side walls of the receptacle housing at an equal interval and in the shorter direction;

each of first shields among the plug shields and the receptacle shields has a pair of shield protrusions extending in the direction for mating with a counterpart connector;

each of second shields, different from the first shields, among the plug shields and the receptacle shields has a pair of points of contact, exposed from the inside of the second shield in the direction for mating with the counterpart connector, to contact the pair of shield protrusions;

each of the pair of points of contact is disposed at an end part of an elastic movable arm extending from a central bend of the second shield toward both ends of the second shield along an inner surface of the second shield; and in a state in which the plug connector and the receptacle connector are mated together, the plug shell and the receptacle shell are electrically connected.

6. The connector device according to claim 5, wherein the movable arm extending toward both ends from the bend of the second shield is formed so as to be bent in the direction for mating with the counterpart connector.

7. A connector comprising:

a plurality of terminals; and a housing holding the plurality of terminals provided along each of two side walls in a longer direction of the housing, and an outer conductor shell held on the housing, wherein:

each of the plurality of terminals has a contact part for contacting a counterpart terminal, and a mounting portion;

the outer conductor shell has plate-shaped shields extending along the longer direction of the housing on both sides, a support held on the housing, and a mounting portion connected to a ground potential of a substrate;

each of the shields is opposed to a mounting end, exposed from the housing, of each of the plurality of terminals provided on the two side walls of the housing, at an equal interval and in a shorter direction;

each of the shields disposed on both sides of the housing has a pair of points of contact exposed from the inside of the shield in the direction for mating with the counterpart connector;

the pair of points of contact is disposed at end parts of an elastic movable arm extending from a central bend of the shield along an inner surface of the shield toward both ends of the shield;

the pair of points of contact is configured such that, in the state of being mated with the counterpart connector, the pair of points of contact is in contact with a pair of shield protrusions provided on the counterpart connector; and in a state of being mated with a counterpart connector, the outer conductor shell is electrically connected with a counterpart outer conductor shell of the counterpart connector.

8. The connector according to claim 7, wherein:

in the state of being mated with the counterpart connector, the outer conductor shell and the counterpart outer conductor shell are arranged without an overlap in the shorter direction.

9. The connector according to claim 8, wherein:

the outer conductor shell has shell planes extending in the longer direction of the housing on both sides; and the shields include edge portions of the outer conductor shell that are bent at right angle to the shell planes.

10. The connector according to claim 7, wherein the movable arm extending from the bend of the shield toward both ends is formed so as to be bent in the direction for mating with the counterpart connector.

11. The connector according to claim 7, wherein the connector is a receptacle connector or a plug connector.

12. A connector comprising:

a plurality of terminals; and a housing holding the plurality of terminals provided along each of two side walls in a longer direction of the housing, and an outer conductor shell held on the housing, wherein:

each of the plurality of terminals has a contact part for contacting a counterpart terminal, and a mounting portion;

the outer conductor shell has plate-shaped shields extending along the longer direction of the housing on both sides, a support held on the housing, and a mounting portion connected to a ground potential of a substrate;

each of the shields is opposed to a mounting end, exposed from the housing, of each of the plurality of terminals provided on the two side walls of the housing, at an equal interval and in a shorter direction;

the outer conductor shell has shell planes extending in the longer direction of the housing on both sides;

the shields include edge portions of the outer conductor shell that are bent at right angle to the shell planes;

each of the shields disposed on both sides of the housing has a pair of points of contact for contacting a pair of shield protrusions provided on the counterpart connector;

the pair of points of contact is disposed at end parts, exposed from a cutout portion formed in the shell planes, of an elastic movable arm extending from a central bend of the shield along an inner surface of the shield toward both ends of the shield;

the pair of points of contact is configured to contact, in the state of being mated with the counterpart connector, the pair of shield protrusions that has entered the inside of the shield through the cutout portion formed in the shell plane; and in a state of being mated with a counterpart connector, the outer conductor shell is electrically connected with a counterpart outer conductor shell of the counterpart connector.

* * * * *